US012193486B2

(12) United States Patent
Cho et al.

(10) Patent No.: US 12,193,486 B2
(45) **Date of Patent: *Jan. 14, 2025**

(54) AEROSOL GENERATING DEVICE

(71) Applicant: KT&G CORPORATION, Daejeon (KR)

(72) Inventors: Byung Sung Cho, Gyeonggi-do (KR); Min Kyu Kim, Seoul (KR); Won Kyeong Lee, Gyeonggi-do (KR); Jong Sub Lee, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 503 days.

This patent is subject to a terminal disclaimer.

(21) Appl. No.: 17/610,013

(22) PCT Filed: May 27, 2021

(86) PCT No.: PCT/KR2021/006613

§ 371 (c)(1),
(2) Date: Nov. 9, 2021

(87) PCT Pub. No.: WO2021/261786

PCT Pub. Date: Dec. 30, 2021

(65) Prior Publication Data

US 2022/0354169 A1 Nov. 10, 2022

(30) Foreign Application Priority Data

Jun. 24, 2020 (KR) ..... 10-2020-0077379

(51) Int. Cl.
*A24F 40/40* (2020.01)
*A24F 40/30* (2020.01)
*A24F 40/51* (2020.01)

(52) U.S. Cl.
CPC ..... *A24F 40/40* (2020.01); *A24F 40/30* (2020.01); *A24F 40/51* (2020.01)

(58) Field of Classification Search
CPC ..... A24F 40/30; A24F 40/40; A24F 40/51
See application file for complete search history.

(56) References Cited

U.S. PATENT DOCUMENTS 9,737,093 B2 8/2017 Hon
10,051,892 B2 8/2018 Rogan et al.
(Continued)

FOREIGN PATENT DOCUMENTS

CN 106231929 A 12/2016
EP 2989912 A1 3/2016
(Continued)

OTHER PUBLICATIONS

International Search Report of PCT/KR2021/006613 dated Aug. 26, 2021 [PCT/ISA/210].
(Continued)

*Primary Examiner* — Michael H. Wilson
*Assistant Examiner* — Ardith Elyse Hertzog
(74) *Attorney, Agent, or Firm* — Sughrue Mion, PLLC

(57) ABSTRACT

An aerosol generating device includes: a first cartridge configured to accommodate a first material and including a delivery hole that is configured to deliver an aerosol generated from the first material; a second cartridge including a plurality of chambers that are each configured to accommodate a second material through which the aerosol delivered from the first cartridge passes and is discharged to the outside, wherein a position of the second cartridge with respect to the first cartridge is changeable so that at least one of the plurality of chambers corresponds to the delivery hole; a position sensor configured to generate a signal by detecting a position of at least one of the plurality of chambers with respect to the delivery hole; and a controller configured to identify a usage chamber based on the signal of the position sensor.

13 Claims, 18 Drawing Sheets

(56) References Cited

U.S. PATENT DOCUMENTS

| | | | | |
|---|---|---|---|---|
| 10,863,772 | B2 | 12/2020 | Borkovec et al. | |
| 2017/0014582 | A1 | 1/2017 | Skoda | |
| 2017/0231277 | A1 | 8/2017 | Mironov et al. | |
| 2018/0007965 | A1 | 1/2018 | Karles | |
| 2018/0184711 | A1 | 7/2018 | Dickens et al. | |
| 2018/0310629 | A1 | 11/2018 | Qiu | |
| 2018/0338542 | A1 | 11/2018 | Rogan et al. | |
| 2018/0369519 | A1 | 12/2018 | Adelson | |
| 2020/0022416 | A1 | 1/2020 | Alarcon | |
| 2020/0113234 | A1 | 4/2020 | Patoret | |
| 2020/0120977 | A1 | 4/2020 | Bless et al. | |
| 2021/0244098 | A1 | 8/2021 | Watson et al. | |
| 2022/0369703 | A1* | 11/2022 | Kim | A24F 40/40 |
| 2023/0143680 | A1* | 5/2023 | Lee | A24F 40/30 131/329 |
| 2023/0189882 | A1* | 6/2023 | Lee | A24F 40/30 131/329 |
| 2023/0200440 | A1* | 6/2023 | Zominy | A24F 40/10 131/329 |
| 2023/0354890 | A1* | 11/2023 | Lee | A24F 40/60 |

FOREIGN PATENT DOCUMENTS

| | | | |
|---|---|---|---|
| JP | 2016-535982 | A | 11/2016 |
| KR | 10-1285225 | B1 | 7/2013 |
| KR | 10-2018-0111845 | A | 10/2018 |
| KR | 10-2019-0042014 | A | 4/2019 |
| KR | 10-2019-0135010 | A | 12/2019 |
| WO | 2013/159245 | A1 | 10/2013 |
| WO | 2015/052192 | A1 | 4/2015 |
| WO | 2016/124717 | A1 | 8/2016 |
| WO | 2017/064323 | A1 | 4/2017 |
| WO | 2019/200200 | A1 | 10/2019 |
| WO | 2020/023547 | A1 | 1/2020 |
| WO | 2021/241932 | A1 | 12/2021 |

OTHER PUBLICATIONS

Written Opinion of PCT/KR2021/006613 dated Aug. 26, 2021 [PCT/ISA/237].

Notification of Reasons for Refusal dated Jan. 31, 2023 from the Japanese Patent Office in application No. 2021-573303.

Office Action dated Apr. 26, 2023 from the Chinese Patent Office in Application No. 202180004405.0.

Office Action dated May 11, 2022 from the Korean Intellectual Property Office in KR Application No. 10-2020-0077379.

Extended European Search Report dated Jun. 28, 2022 from the European Patent Office in EP Application No. 21798536.5.

* cited by examiner

AEROSOL GENERATING DEVICE

TECHNICAL FIELD

One or more embodiments of the present disclosure relate to an aerosol generating device, and more particularly, to an aerosol generating device in which positions of chambers according to changes in the relative positions of a first cartridge and a second cartridge may be identified so that it may be convenient to carry and use the aerosol generating device.

BACKGROUND ART

Recently, there is an increasing demand for generating aerosols using non-combustion method, rather than by combusting cigarettes. For example, an aerosol generating device may be a device delivering aerosol to a user by generating aerosol with a non-combustion method or a device delivering fragrant aerosol by generating aerosol from aerosol generating material and passing the aerosol through a flavor medium.

DISCLOSURE OF INVENTION

Technical Problem

There is need for aerosol generating devices that are easier to use and carry, and that generate aerosol of good quality that may satisfy various needs of consumers.

Solution to Problem

One or more embodiments of the present disclosure provide an aerosol generating device that may solve the above described problems.

Technical goals to be achieved by embodiments of the present disclosure are not limited to the above-described goals, and goals that are not mentioned will be clearly understood by one of ordinary skill in the art from the present specification and the accompanying drawings.

According to an aspect of the present disclosure, an aerosol generating device includes a first cartridge accommodating a first material and including a delivery hole through which an aerosol generated from a first material is delivered, a second cartridge including a plurality of chambers for accommodating a second material through which the aerosol delivered from the first cartridge passes and is discharged to the outside, wherein the position of the second cartridge with respect to the first cartridge is changeable so that at least one of the plurality of chambers corresponds to the delivery hole, a position sensor configured to detect a position of at least one of the chambers with respect to the delivery hole and to generate a signal, and a controller configured to identify a usage chamber, which is aligned to correspond to a position of the delivery hole among the chambers and in use to pass the aerosol, based on the signal of the position sensor.

Advantageous Effects of Invention

An aerosol generating device according to one or more embodiments may be handled as one device in which a first cartridge for accommodating a first material and a second cartridge for accommodating a second material are integrated with each other and thus is convenient to carry and use.

In addition, because chambers of the second cartridge may contain different types of second materials and a user may select one of the chambers to select a desired second material, the user may freely enjoy an aerosol having various flavors.

In addition, because a usage chamber currently in use may be identified based on a signal of a position sensor, reliable and stable control of the aerosol generating device is possible, and information on the usage chamber may be transmitted to the user so that the convenience of use may be increased.

In addition, even if the first cartridge of the aerosol generating device is designed to contain a large amount of the first material, the relative positions of the first cartridge and the second cartridge may be automatically changed by a driving device to select the chambers used for supplying the aerosol, the effect of replacing the second cartridge including the second material with a new second material may be obtained without replacing the second cartridge including the second material.

In addition, because the relative positions of the first cartridge and the second cartridge are adjusted to select the chambers used for supplying the aerosol, the effect of replacing a cartridge for a medium with a new medium may be obtained without replacing the cartridge for the medium.

BEST MODE FOR CARRYING OUT THE INVENTION

Figure 1:
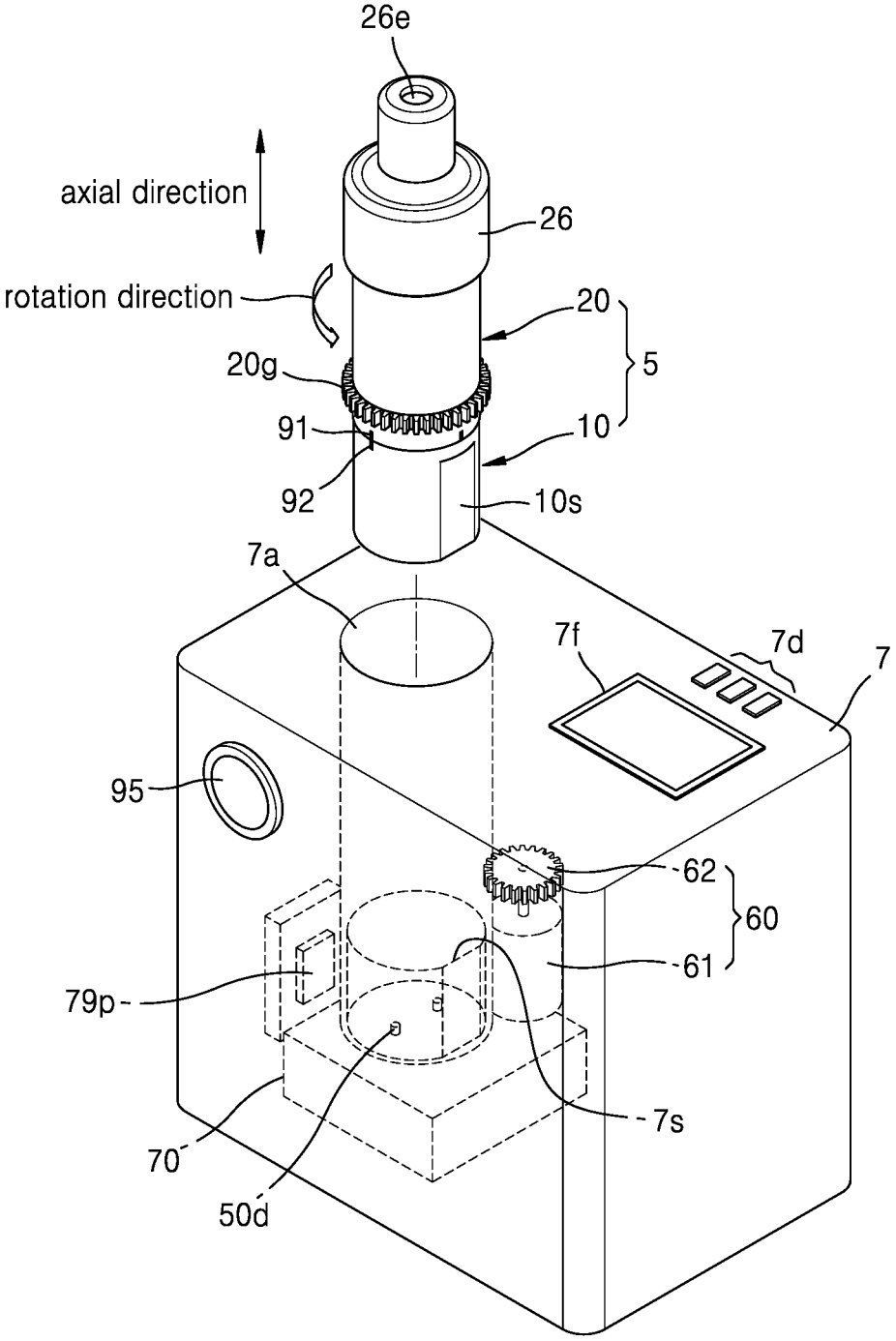
FIG. 1 is a perspective view of an aerosol generating device according to an embodiment.

According to one or more embodiments, an aerosol generating device is provided. The aerosol generating device includes: a first cartridge configured to accommodate a first material and comprising a delivery hole that is configured to deliver an aerosol generated from the first material; a second cartridge comprising a plurality of chambers that are each configured to accommodate a second material through which the aerosol delivered from the first cartridge passes and is discharged to the outside, wherein a position of the second cartridge with respect to the first cartridge is changeable so that at least one of the plurality of chambers corresponds to the delivery hole; a position sensor configured to generate a signal by detecting a position of at least one of the plurality of chambers with respect to the delivery hole; and a controller configured to identify a usage chamber, among the plurality of chambers and which is aligned to correspond to a position of the delivery hole to pass the aerosol, based on the signal of the position sensor.

According to an embodiment, the aerosol generating device further includes a driving device configured to change a relative position of the second cartridge with respect to the first cartridge by moving at least one from among the first cartridge and the second cartridge, wherein the controller is configured to operate the driving device to change the relative position of the second cartridge with respect to the first cartridge so that the aerosol is able to pass through at least one of the plurality of chambers.

According to an embodiment, the aerosol generating device further includes a reference sensor arranged on a movement path of the plurality of chambers between the first cartridge and the second cartridge, and configured to generate a reference position signal indicating a reference position of the second cartridge with respect to the first cartridge, wherein, based on the reference sensor generating the reference position signal, the controller is configured to convert a movement direction of any one from among the first cartridge and the second cartridge into an opposite direction.

According to an embodiment, the aerosol generating device further includes a stopper arranged on a movement path of the plurality of chambers between the first cartridge and the second cartridge, and configured to be in contact with any one from among the first cartridge and the second cartridge to limit position movement, wherein, when any one from among the first cartridge and the second cartridge is moved in one direction by the driving device and comes into contact with the stopper, the controller is configured to control the driving device to attempt to further move the any one from among the first cartridge and the second cartridge in the one direction and then convert a movement direction of the any one from among the first cartridge and the second cartridge into an opposite direction.

According to an embodiment, the aerosol generating device further includes a handle that is configured to be manipulated by a user so as to change relative positions of the first cartridge and the second cartridge, and is further configured to transmit force of the user to move at least one from among the first cartridge and the second cartridge.

According to an embodiment, the aerosol generating device further includes an information generator that is configured to be controlled by the controller to output information on the usage chamber, among the plurality of chambers, which is aligned to correspond to the position of the delivery hole to pass the aerosol.

According to an embodiment, the position sensor includes: a plurality of electric resistors that are arranged at different positions between the first cartridge and the second cartridge and have different electric resistance values from each other so as to correspond to changes in relative positions of the first cartridge and the second cartridge, and a conducting wire configured to be electrically connected to the plurality of electric resistors, wherein the controller is configured to identify the position of the at least one of the plurality of chambers based on electricity flowing through at least one of the plurality of electric resistors.

According to an embodiment, the position sensor includes: a plurality of magnetic bodies that are arranged at different positions between the first cartridge and the second cartridge and have magnetism with different strengths from each other so as to correspond to changes in relative positions of the first cartridge and the second cartridge, and a magnetism sensor configured to detect the magnetism of the plurality of magnetic bodies.

According to an embodiment, when the position of the at least one of the plurality of chambers is aligned to correspond to the delivery hole, the position sensor generates a unique identification signal corresponding to the at least one of the plurality of chambers that is aligned.

According to an embodiment, the position sensor includes at least one switch that is positioned on a movement path of the plurality of chambers between the first cartridge and the second cartridge, the at least one switch configured to operate according to changes in relative positions of the first cartridge and the second cartridge to generate a position signal indicating positions of the plurality of chambers.

According to an embodiment, the aerosol generating device further includes: a handle that is configured to be manipulated by a user so as to change relative positions of the first cartridge and the second cartridge, and a force transmission unit configured to transmit force of the user, transmitted to the handle, to any one from among the first cartridge and the second cartridge, wherein the position sensor comprises at least one switch that is connected to at least one from among the handle and the force transmission unit, and the signal of the position sensor indicates positions of the plurality of chambers according to changes in the relative positions of the first cartridge and the second cartridge.

According to an embodiment, any one from among the first cartridge and the second cartridge is rotatably coupled to the other one from among the first cartridge and the second cartridge, and the position sensor is configured to detect changes in a rotation position of the any one from among the first cartridge and the second cartridge.

According to an embodiment, any one from among the first cartridge and the second cartridge is linearly and movably coupled to the other one from among the first cartridge and the second cartridge, and the position sensor is configured to detect changes in a linear position of the any one from among the first cartridge and the second cartridge.

According to an embodiment, the controller is configured to identify that two adjacent chambers of the plurality of chambers, which are both aligned to correspond to the position of the delivery hole to pass the aerosol, are simultaneous usage chambers based on the signal of the position sensor.

According to an embodiment, the aerosol generating device further includes a driving device configured to change a relative position of the second cartridge with respect to the first cartridge by moving at least one from among the first cartridge and the second cartridge, wherein the controller is configured to operate the driving device to change the relative position of the second cartridge with respect to the first cartridge so that the aerosol is able to simultaneously pass through the two adjacent chambers of the plurality of chambers.

MODE FOR THE INVENTION

With respect to the terms used to describe the various embodiments of the present disclosure, general terms which are currently and widely used are selected in consideration of functions of structural elements in the various embodiments of the present disclosure. However, the meaning of the terms can be provided according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used to describe the various embodiments of the present disclosure should be defined based on the meaning of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

If one component or layer is mentioned to be "over," "above," "connected to," or "combined with" another component or layer, the one component or layer is arranged to be over, above, connected to, or combined with the other component or layer with or without an intervening component(s) or layer(s). In contrast, if one component or layer is mentioned to be "directly over," "directly above," "directly connected to," or "directly combined with" another component or layer, there is no additional components or layers between the components or layers. In the disclosure, the same reference numbers may indicate the same components.

Hereinafter, embodiments of the present disclosure will be described more fully with reference to the accompanying drawings, in which non-limiting example embodiments of the present disclosure are shown such that one of ordinary skill in the art may easily work the present disclosure. Embodiments of the present disclosure may, however, be embodied in many different forms and should not be construed as being limited to the example embodiments set forth herein.

Figure 2:
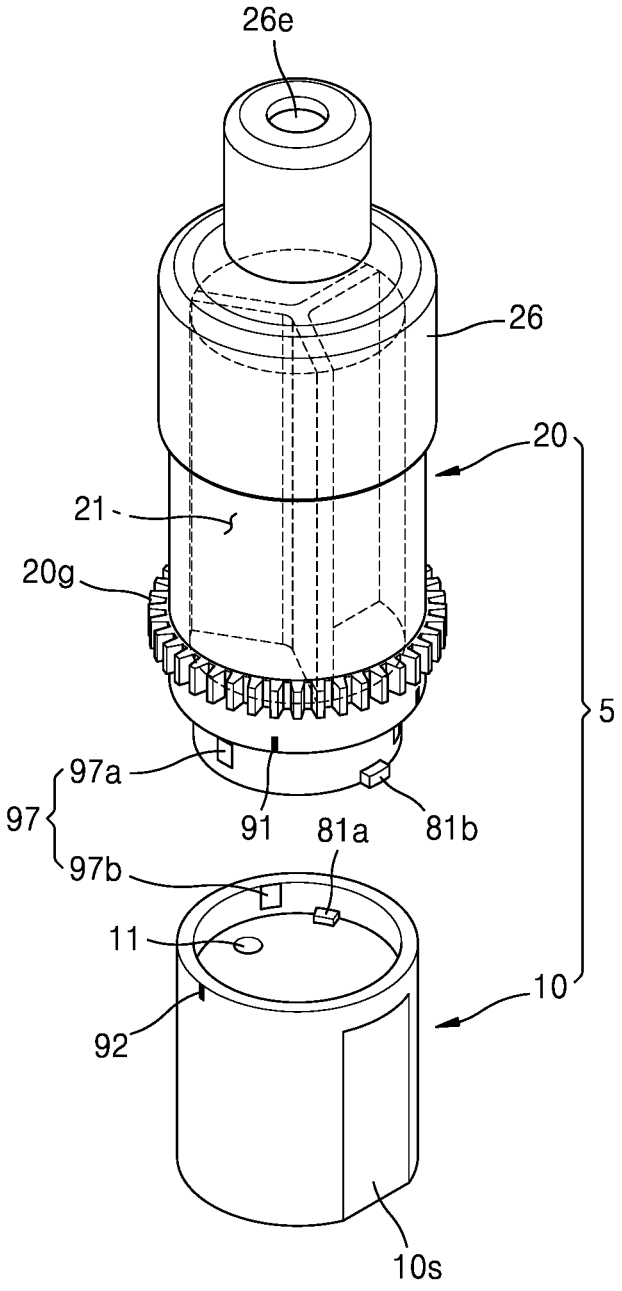
FIG. 2 is a perspective view illustrating a separated state of some components of the aerosol generating device according to the embodiment shown in FIG. 1.
Figure 3:
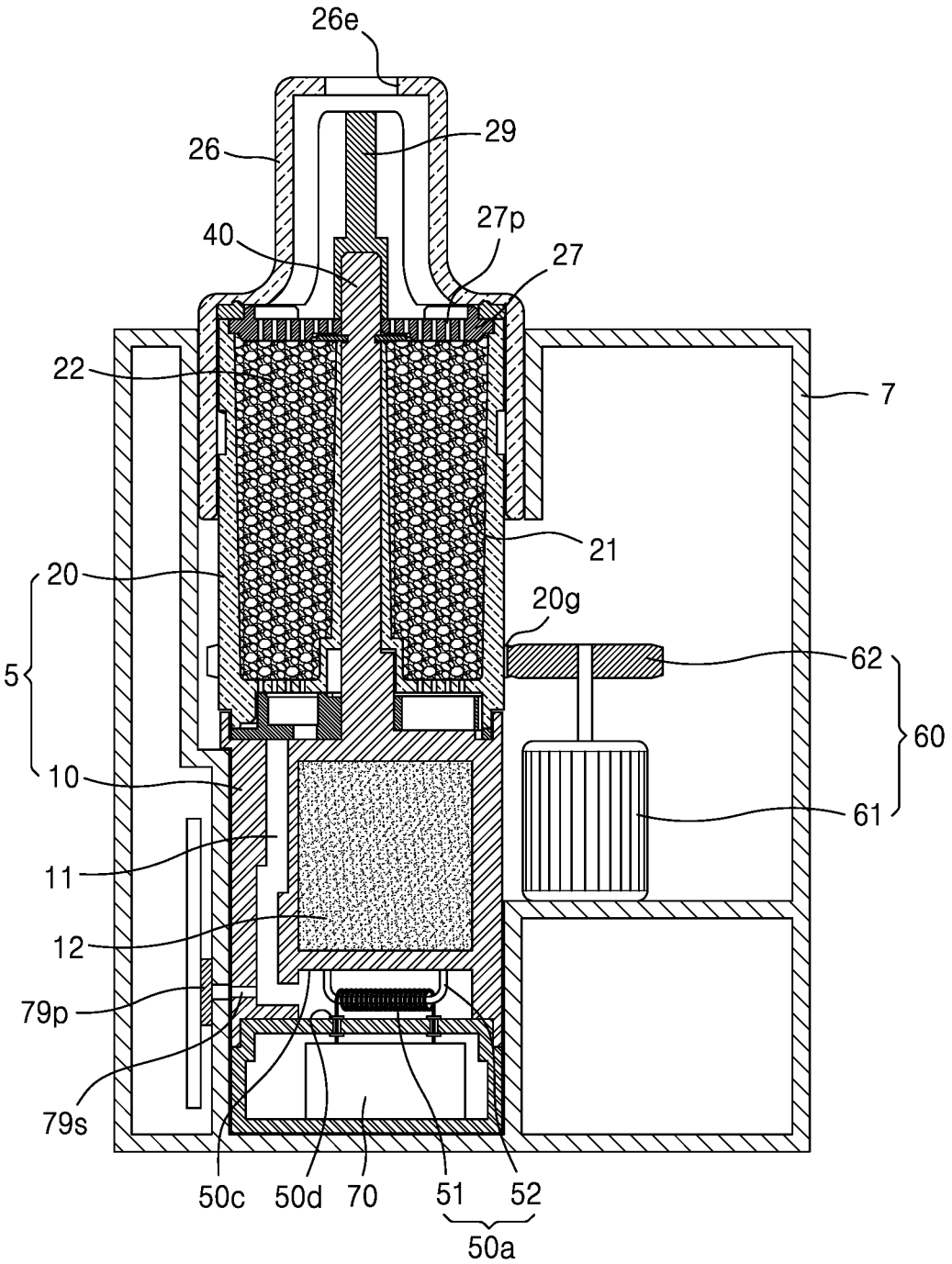
FIG. 3 is a longitudinal cross-sectional view of the aerosol generating device according to the embodiment shown in FIG. 1.

FIG. 1 is a perspective view of an aerosol generating device according to an embodiment, FIG. 2 is a perspective view illustrating a separated state of some components of the aerosol generating device according to the embodiment shown in FIG. 1, and FIG. 3 is a longitudinal cross-sectional view of the aerosol generating device according to the embodiment shown in FIG. 1.

The aerosol generating device according to the embodiment shown in FIGS. 1 through 3 is a device for performing a function of supplying an aerosol to a user, may be a device that heats an aerosol generating material by using a heater operating using electricity, an induction magnetic field, or ultrasonic waves so as to generate an aerosol.

Referring to FIG. 3, the aerosol generating device may include a first cartridge 10 accommodating a first material 12 and including a delivery hole 11 through which an aerosol generated from the first material 12 is delivered, and a second cartridge 20 including a plurality of chambers 21 for accommodating a second material 22 through which the aerosol delivered from the first cartridge 10 passes and is discharged to the outside.

The first cartridge 10 and the second cartridge 20 may be integrated with each other so as to be handled as one part and to form an aerosol generating assembly 5.

Referring to FIG. 1, the aerosol generating device may include a case 7 including an accommodation passage 7*a* for accommodating the aerosol generating assembly 5. The case 7 may include a display device 7*f* for transmitting information to a user and a display lamp 7*d* for transmitting a notification related to an operating state of the aerosol generating device to the user, wherein the display device 7*f* and the display lamp 7*d* are arranged on an outer surface of the case 7. The display device 7*f* and the display lamp 7*d* may be examples of information generators for performing a function of notifying various types of notifications to the user, and an information generator may be in the form of, for example, a speaker or a vibration generator.

In addition, the case 7 may include an input device 95 that may be manipulated by the user and generates a user input signal by detecting the user's manipulation.

In the embodiment shown in FIGS. 1 through 3, the case 7 may have an approximately rectangular parallelepiped shape, and the aerosol generating assembly 5 may have a cylindrical shape that extends long in an axial direction. However, embodiments of the present disclosure are not limited to the shapes of the case 7 and the aerosol generating assembly 5 as shown in FIGS. 1 through 3. For example, the case 7 may have other shapes such as a cylindrical shape that extends long in the axial direction, a cylindrical shape having an elliptical cross-section, a flat cylindrical shape, a regular cube, and a rectangular parallelepiped. In addition, the aerosol generating assembly 5 may have other shapes such as a rectangular parallelepiped, a regular cube, and the like.

The first cartridge 10 and the second cartridge 20 may be coupled to each other so that relative positions of the first cartridge 10 and the second cartridge 20 may be changed. In the embodiment shown in FIGS. 1 through 3, the second cartridge 20 rotates relative to the first cartridge 10 so that the relative positions of the first cartridge 10 and the second cartridge 20 may be changed. The first cartridge 10 may have a cylindrical shape as a whole and include a position fixing surface 10*s* which is at least partially formed differently from the extension direction of the cylindrical surface.

The accommodation passage 7*a* of the case 7 may be formed as a hollow cylindrical path that extends long to accommodate the aerosol generating assembly 5. A position maintenance surface 7*s* may be formed on at least a portion of the accommodation passage 7*a* to be different from the extension direction of the cylindrical surface of an inner wall surface of the accommodation passage 7*a* so as to have a shape corresponding to the position fixing surface 10*s* of the first cartridge 10.

When the aerosol generating assembly 5 is accommodated in the accommodation passage 7*a* of the case 7, the position maintenance surface 7*s* and the position fixing surface 10*s* are in contact with each other, and accordingly, the position of the first cartridge 10 with respect to the case 7 may be stably maintained. That is, when the second cartridge 20 rotates with respect to the first cartridge 10, the position fixing surface 10*s* of the first cartridge 10 is supported by the position maintenance surface 7*s* so that a state in which the first cartridge 10 does not rotate but is fixed to the case 7, may be stably maintained.

In addition, when the aerosol generating assembly 5 is inserted into the accommodation passage 7*a* of the case 7, the position maintenance surface 7*s* and the position fixing surface 10*s* may perform an alignment function of aligning the relative positions of an axial center of the aerosol generating assembly 5 with respect to an axial center of the accommodation passage 7*a*. That is, the position fixing surface 10*s* of the first cartridge 10 and the position maintenance surface 7*s* of the accommodation passage 7*a* of the aerosol generating assembly 5 may be required to correspond to each other so that the aerosol generating assembly 5 may be inserted into the accommodation passage 7*a* of the case 7.

The case 7 may include an electrical terminal 50*d* that is arranged at an end of the accommodation passage 7*a* and supplies electricity to the first cartridge 10. When the aerosol generating assembly 5 is aligned with respect to the accommodation passage 7*a* so that the position fixing surface 10*s* of the first cartridge 10 and the position maintenance surface 7*s* of the accommodation passage 7*a* of the aerosol generating assembly 5 correspond to each other, the electrical terminal 50*d* may be accurately connected to the first cartridge 10.

Embodiments of the present disclosure are not limited by the coupling structure of the first cartridge 10 and the second cartridge 20 described above, and the first cartridge 10 and the second cartridge 20 may be rotatably coupled to each other by using various coupling structures. For example, the first cartridge 10 may rotate with respect to the second cartridge 20 in a state in which the position of the second cartridge 20 is fixedly maintained at the case 7 by modifying the structure of the aerosol generating assembly 5 shown in FIGS. 1 through 3. Alternatively, each of the first cartridge 10 and the second cartridge 20 may rotate so that the relative positions of the first cartridge 10 and the second cartridge 20 may be changed.

The first cartridge 10 may perform a function of delivering the aerosol generated by an atomizer 50*a* embedded in the case 7 to the second cartridge 20.

The first cartridge 10 may accommodate the first material 12 therein. The first material 12 may be, for example, a liquid or gel material. The first material 12 may be maintained in a liquid state by being impregnated within a porous material such as a sponge or cotton inside the first cartridge 10.

The first material 12 may be a liquid material and may include, for example, a tobacco-containing material or a non-tobacco material including a volatile tobacco flavor component.

The first material 12 may include, for example, water, a solvent, ethanol, plant extract, spices, flavorings, or a vitamin mixture.

The spices of the first material 12 may include menthol, peppermint, spearmint, and various fruit-flavored ingredients, but are not limited thereto. The flavorings may include ingredients capable of providing various flavors or tastes to a user.

Vitamin mixtures of the first material 12 may be a mixture of at least one of vitamin A, vitamin B, vitamin C, and vitamin E, but are not limited thereto.

Also, the first material 12 may include an aerosol forming substance, such as glycerin and propylene glycol.

The atomizer 50*a* and a controller 70 are installed at a lower side of the accommodation passage 7*a* inside the case 7 and may generate an aerosol by heating the first material 12 of the first cartridge 10. The controller 70 may include a battery for supplying power to the atomizer 50*a* and a control chip or control circuit board for controlling the operation of the atomizer 50*a*.

The atomizer 50*a* may include a wick 52 that absorbs the first material 12 from the first cartridge 10 and holds the first material 12, a heater 51 that is wound around the wick 52, is in contact with the wick 52 or is adjacent to the wick 52 to heat the first material 12 so as to generate an aerosol, and an aerosol generating chamber 50*c* that surrounds the heater 51 and creates an atmosphere for generating the aerosol.

The atomizer 50*a* may perform a function of converting a phase of the aerosol generating material into a gaseous phase to generate an aerosol. The aerosol may refer to a gas in which vaporized particles generated from the aerosol generating material are mixed with air.

The heater 51 may be an electric resistive heating element that generates heat by electricity supplied from the controller 70. The atomizer 50*a* includes the electric resistive heating element. However, embodiments of the present disclosure are not limited by such configuration of the atomizer 50*a*. The atomizer 50*a* may generate an aerosol, for example, by an ultrasonic method or by a heating method.

The first cartridge 10 may include the delivery hole 11 that extends along the extension direction of the first cartridge 10 to deliver the aerosol. The aerosol generating chamber 50*c* may deliver the aerosol generated by the heater 51 to the delivery hole 11 of the first cartridge 10. Thus, the aerosol supplied from the aerosol generating chamber 50*c* may be delivered to the second cartridge 20 through the delivery hole 11 of the first cartridge 10.

The second cartridge 20 may be disposed to rotate with respect to the first cartridge 10 and include a plurality of chambers 21 which are sequentially positioned along the rotation direction of the second cartridge 20, and a second material 22, which is accommodated in each of the plurality of chambers 21 and through which the aerosol passes.

The second material 22 may be in a solid state and may include, for example, a powder or a granule, which is a collection of small-sized particles.

The second material 22 may include, for example, a tobacco-containing material including a volatile tobacco flavor component, or may include any one component of additives such as flavors, a wetting agent, and/or organic acid, a flavored material such as menthol or a moisturizer, plant extract, spices, flavorings, and a vitamin mixture, or a mixture of these ingredients.

The spices of the second material 22 may include menthol, peppermint, spearmint, and various fruit-flavored ingredients, but are not limited thereto.

The flavorings of the second material 22 may include ingredients capable of providing various flavors or tastes to the user.

The vitamin mixtures of the second material 22 may be a mixture of at least one of vitamin A, vitamin B, vitamin C, and vitamin E, but are not limited thereto.

The second cartridge 20 may include a plurality of chambers 21, which are positioned to be sequentially apart from one another along the rotation direction of the second cartridge 20. The chambers 21 may be partitioned independently from each other by a partition wall.

As shown in FIG. 2, three chambers 21 are installed. However, embodiments of the present disclosure are not limited to this number of chambers 21, and two or more chambers 21 may also be installed.

Referring to FIG. 3, the first cartridge 10 may include a rotation shaft 40 that protrudes upward. The rotation shaft 40 may protrude from the first cartridge 10 upward, and the second cartridge 20 may be rotatably coupled to the rotation shaft 40.

A mouthpiece 26 including an outlet 26*e* for discharging the aerosol passing through the second material 22 of at least one of the chambers 21 to the outside may be coupled to an upper portion of the second cartridge 20. An upper plate 27 for covering upper ends of the chambers 21 may be arranged on an upper portion of the chambers 21. The upper plate 27 may include an upper through hole 27*p* through which the aerosol passes.

A flow guide 29 may be coupled to the upper end of the rotation shaft 40 that protrudes from the upper surface of the upper plate 27. The flow guide 29 may be positioned inside the mouthpiece 26 and may perform a function of inducing the flow of the aerosol passing through the second material 22 of the chambers 21 to the outlet 26*e* of the mouthpiece 26. The flow guide 29 may include a plurality of wings each corresponding to the chambers 21.

The relative positions of the first cartridge 10 and the second cartridge 20 in a state in which the first cartridge 10 and the second cartridge 20 are coupled to each other, may be changed so that at least one of the plurality of chambers 21 of the second cartridge 20 may correspond to the delivery hole 11 of the first cartridge 10. Thus, the aerosol discharged from the delivery hole 11 of the first cartridge 10 may pass through the second material 22 accommodated in the chamber, among the plurality of chambers 21 of the second cartridge 20, which corresponds to the delivery hole 11. While the aerosol passes through the second material 22, the characteristics of the aerosol may be changed.

The aerosol generating device may further include a driving device 60 that generates a driving force to move at least one of the first cartridge 10 and the second cartridge 20. Referring to FIGS. 1 and 3, the driving device 60 may include a motor 61 that is disposed inside the case 7 and operates by an electrical signal, and a gear 62 that delivers the driving force of the motor 61 to the second cartridge 20. A gear surface 20*g* may be installed outside the second cartridge 20 to extend along the rotation direction of the second cartridge 20.

When the aerosol generating assembly 5 is mounted on the case 7, the gear surface 20*g* of the second cartridge 20 may be coupled to the gear 62. When the electrical signal is applied to the motor 61 of the driving device 60 from the controller 70, a shaft of the motor 61 may make a rotational motion, and the driving force of the motor 61 may be delivered to the gear surface 20*g* of the second cartridge 20 through the gear 62. Thus, the driving device 60 may perform a function of rotating the second cartridge 20 with respect to the first cartridge 10.

Embodiments of the present disclosure are not limited by the configuration of the driving device 60 shown in FIGS. 1 and 3. For example, the driving device 60 may be connected to the first cartridge 10 and may rotate the first cartridge 10. Also, the gear 62 of the driving device 60 may be replaced with various power transmission elements such as a belt, a sprocket, and the like.

Here, an operation state, in which the position of at least one of the plurality of chambers 21 of the second cartridge 20 corresponds to the position of the delivery hole 11 of the first cartridge 10, may include both the state where the position of any one of the plurality of chambers 21 corresponds to the position of the delivery hole 11 of the first cartridge 10 and the state where the positions of two adjacent chambers 21 of the plurality of chambers 21 correspond to the position of the delivery hole 11 of the first cartridge 10.

Referring to FIGS. 1 and 2, the second cartridge 20 includes a mark 91 installed on an outer surface of the second cartridge 20. The second cartridge 20 may include a plurality of chambers 21 therein, and the mark 91 of the second cartridge 20 is formed at a position corresponding to each of the chambers 21.

The first cartridge 10 may include a mark 92 that may be used as a reference position with respect to the mark 91 of the second cartridge 20 at an outer surface of the first cartridge 10. Thus, the mark 91 of the second cartridge 20 may coincide with the mark 92 of the first cartridge 10 so that the position of at least one of the chambers 21 may be aligned with the position of the delivery hole 11 of the first cartridge 10 through which the aerosol is discharged.

Also, the user may check the positions of the mark 91 of the second cartridge 20 and the mark 92 of the first cartridge 10 to identify information of a chamber through which the aerosol currently passes, among the chambers 21 of the second cartridge 20.

A position sensor 97 that indicates the type of the second material 22 included in the chamber, among the chambers 21, through which the aerosol currently passes according to the relative positions of the first cartridge 10 and the second cartridge 20 may be installed between the first cartridge 10 and the second cartridge 20. The position sensor 97 may perform a function of generating a signal by detecting the position of at least one of the chambers 21 with respect to the delivery hole 11.

The position sensor 97 may include a transmitter 97*a* arranged in the second cartridge 20 and one or more receivers 97*b* that is disposed in the first cartridge 10 and detects the transmitter 97*a*. Embodiments of the present disclosure are not limited by the arrangement positions or the number of the transmitter 97*a* and receivers 97*b*. For example, the transmitter 97*a* may be arranged in the first cartridge 10, and the receivers 97*b* may be arranged in the second cartridge 20.

When the position of at least one of the chambers 21 is aligned to correspond to the delivery hole 11, the position sensor 97 may generate an identification signal corresponding to the aligned chamber that is different from identification signals corresponding to non-aligned chambers.

The transmitter 97*a* and the receivers 97*b* of the position sensor 97 may be implemented by one among an optical sensor such as a photocoupler, a magnetic sensor that detects magnetism by using a hall effect, an electric resistance sensor that detects changes in electric resistance, a switch that generates a signal according to a physical contact, and a combination thereof.

Referring to FIGS. 1 and 3, a puff sensor 79*p* may be arranged on a path along which the aerosol flows, inside the case 7. The puff sensor 79*p* may perform a function of detecting a flow phenomenon of the aerosol generated according to the user's aerosol inhalation operation. The puff sensor 79*p* may be connected to the delivery hole 11, for example, to detect fluctuations in pressure of fluid, i.e., a fluid including the aerosol flowing through the delivery hole 11 or flow rate according to the flow of air, and generate a signal. The puff sensor 79*p* may be arranged in a pressure detection hole 79*s* connected to the delivery hole 11.

When using the aerosol generating device described above, the aerosol delivered from the first cartridge 10 and that enters at least one of the chambers 21 of the second cartridge 20 may pass through the second material 22 accommodated in the at least one of the chambers 21. The second material 22 may provide flavors to the aerosol. The aerosol that passes through the second material 22 and includes sufficient flavors may pass through the upper through hole 2'7*p* of the upper plate 27 disposed at an upper portion of the chambers 21 and then may be discharged to the outside of the aerosol generating device through the mouthpiece 26.

When pre-set conditions are achieved, the controller 70 may operate the driving device 60 to perform a function of changing the relative positions of the first cartridge 10 and the second cartridge 20 so that the aerosol delivered from the first cartridge 10 may pass through at least one of the chambers 21. That is, the second material 22 included in the chambers 21 of the second cartridge 20 has a pre-set usage time in relation to an operation of passing the aerosol, and when an actual usage time used to perform the operation of passing the aerosol through the second material 22 reaches the pre-set usage time, the positions of the chambers through which the aerosol passes may need to be changed.

The controller 70 may change the relative position of the second cartridge 20 with respect to the first cartridge 10 to perform a function of selecting another one or adjacent chambers 21 of the chambers 21 of the second cartridge 20 so as to pass the aerosol.

Also, the controller 70 may perform a function of identifying a usage chamber, among the chambers 21, that is aligned to correspond to the position of the delivery hole 11 to be used to pass the aerosol, based on the signal of the position sensor 97. Here, the 'usage chamber' is a name that refers to one of the chambers 21, and is the term for indicating at least one of the chambers 21 that is aligned to correspond to the position of the delivery hole 11 and in use to perform a function of passing the aerosol.

Referring to FIG. 2, stoppers 81*a* and 81*b* may be installed between the first cartridge 10 and the second cartridge 20 so as to limit changes in the relative positions of the first cartridge 10 and the second cartridge 20. The stoppers 81*a* and 81*b* may be arranged on a movement path of the chambers 21 between the first cartridge 10 and the second cartridge 20. The stoppers 81*a* and 81*b* may perform a function of limiting a relative motion of the second cartridge 20 with respect to the first cartridge 10. The relative motion of the second cartridge 20 with respect to the first cartridge 10 is for changing positions of the chambers 21 with reference to the delivery hole 11. Here, the 'movement path' of the chambers 21 does not mean a physical path through which the chambers 21 pass, but refers to a path in a circumferential direction along which outer edges on which the stoppers 81*a* and 81*b* of the second cartridge 20 are installed, move along a path in which the chambers 21 move in the circumferential direction as the second cartridge 20 rotates.

When the second cartridge 20 makes a rotational motion in one direction with respect to the first cartridge 10 and the stoppers 81*a* and 81*b* are in contact with each other, the second cartridge 20 may no longer make a rotational motion, and the driving device 60 may convert the direction of the rotational motion of the second cartridge 20 into an opposite direction. The operation of the driving device 60 in relation to the stoppers 81*a* and 81*b* will be described in more detail with reference to FIGS. 5 through 7 below.

Figure 4:
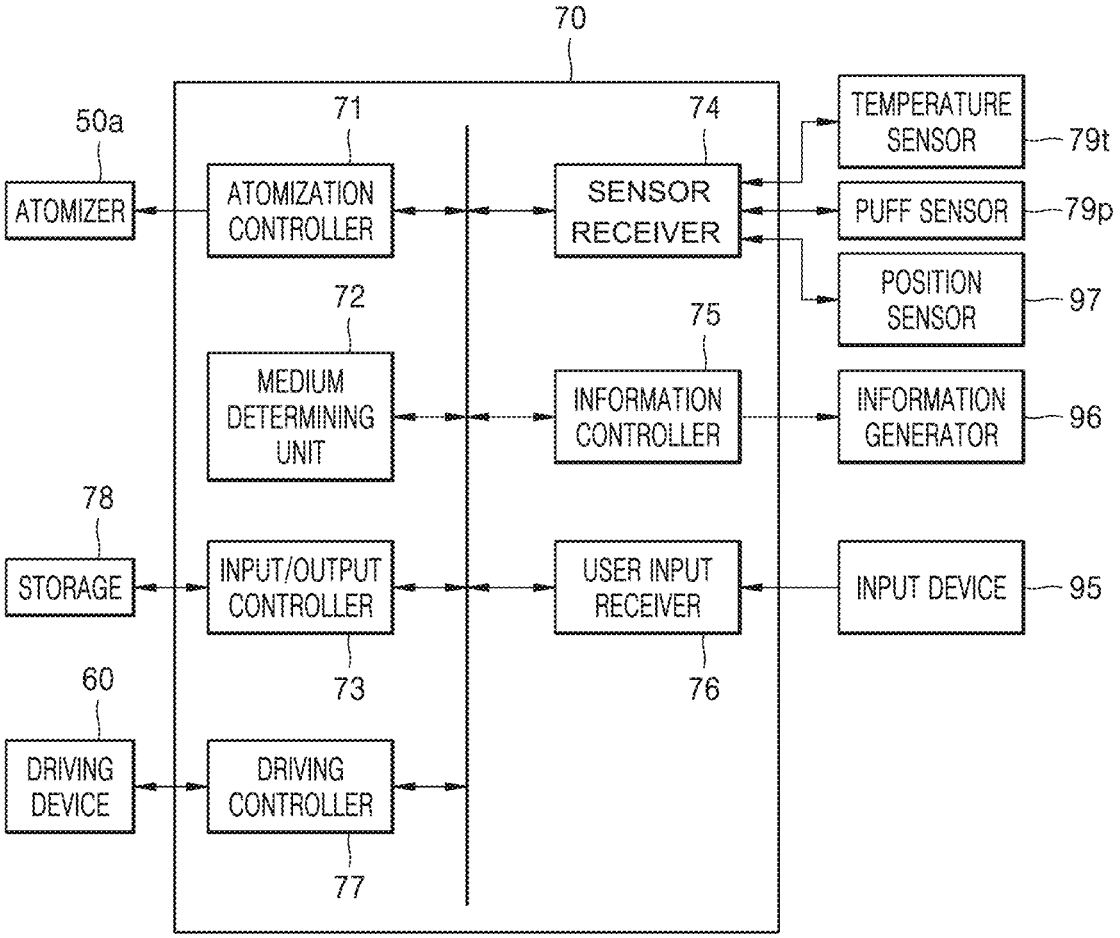
FIG. 4 is a block diagram schematically illustrating a connection relationship between some components of the aerosol generating device according to the embodiment shown in FIG. 1.

FIG. 4 is a block diagram schematically illustrating a connection relationship between some components of the aerosol generating device according to the embodiment shown in FIG. 1.

The controller 70 shown in FIG. 4 may be implemented by any one of a circuit board arranged inside the case 7 shown in FIGS. 1 and 3, a semiconductor chip attached to the circuit board, and software installed on the semiconductor chip or circuit board, or a combination thereof.

The controller 70 may include an atomization controller 71 that controls the atomizer 50*a* to control the generation amount or the temperature of the aerosol; a sensor receiver 74 that receives signals generated according to a temperature sensor 79*t* for detecting the temperature related to the atomizer 50*a*, a puff sensor 79*p* for detecting changes in pressure or speed of air generated when the user inhales the aerosol, and the position sensor 97 shown in FIG. 2 that detects the rotation position of the second cartridge 20 with respect to the first cartridge 10; an information controller 75 that controls an information generator 96 for providing information to the user or providing a notification; a user input receiver 76 that receives a user input signal from an input device 95 that is a user input device such as a button, a touch screen, or an input button for detecting the user's input operation; an input/output controller 73 that exchanges data with a storage 78 including information on the type of the first material of the first cartridge 10 or the second material of the second cartridge 20, a temperature profile for controlling the operating temperature of the atomizer 50*a*, information on the user, and/or information on the positions of the chambers 21 with respect to the delivery hole 11 according to changes in the relative positions of the first cartridge 10 and the second cartridge 20; a medium determining unit 72 that determines a usage chamber currently in use to pass the aerosol based on the signal received from the position sensor 97 and the type of a medium contained in the usage chamber; and a driving controller 77 for controlling the operation of the driving device 60.

According to embodiments, the controller 70 may comprise at least one processor and memory storing computer instructions. The computer instructions, when executed by the at least one processor, may cause the at least one processor to implement any number of the atomization controller 71, the medium determining unit 72, the input/ output controller 73, the sensor receiver 74, the information controller 75, and the user input receiver 76, and perform the functions thereof.

The controller 70 described above may detect the user's inhalation operation, thereby initiating or stopping the operation of the atomizer 50*a*. Also, the controller 70 may determine the usage chamber currently in use to pass the aerosol based on the signal applied from the position sensor 97 and the type of the medium contained in the usage chamber and may control the operating temperature or operating time of the atomizer 50*a* to be suitable for the type of medium.

The controller 70 may determine the usage chamber currently in use to pass the aerosol based on the signal applied from the position sensor 97 and the type of the medium contained in the usage chamber and then may output information (e.g. a pre-set identification number of the usage chamber) on the type of the usage chamber, to the information generator 96. The pre-set identification number of the usage chamber may include, for example, numbers, characters, or symbols. Also, the controller 70 may output information on the type of the medium contained in the usage chamber, for example, the name of the medium and/or the characteristics of the medium (e.g. information on flavors or use life) to the information generator 96.

The controller 70 may operate the driving device 60 when the pre-set conditions are achieved. The pre-set conditions for changing the relative positions of the first cartridge 10 and the second cartridge 20 by operating the driving device 60 by using the controller 70 may include a cumulative time of heating operations of generating heat by using the heater so as to generate an aerosol or a combination of the cumulative time of heating operations of the heater and the heating temperature of the heater.

When the pre-set conditions are achieved, the controller 70 may first generate a notification notifying that the relative positions of the first cartridge 10 and the second cartridge 20 need to be changed, through the information generator 96. When the user checks the notification to manipulate the input device 95, the controller 70 may operate the driving device 60 based on the input signal applied from the input device 95 so as to change the relative positions of the first cartridge 10 and the second cartridge 20.

When the pre-set conditions include the cumulative time of heating operations of the heater, the controller 70 may calculate the amount of current or the amount of power supplied to the heater by using the atomization controller 71 or may calculate the cumulative time of heating operations of the heater by summing up time when the current is supplied to the heater. For example, when the aerosol passes through the second material 22 included in one of the chambers 21 of the second cartridge 20 and time when flavors are provided to the aerosol is pre-set to n minutes, the controller 70 may determine that, when the cumulative time of heating operations of the heater reaches n minutes, the use of a chamber currently passing the aerosol needs to be ended, thereby changing the relative position of the second cartridge 20 to the first cartridge 10 and selecting a new chamber through which the aerosol from among the chambers 21 passes.

The heating operation of the heater may include a main heating operation of generating heat at a sufficient temperature to vaporize the first material of the first cartridge 10 and a pre-heating operation of generating heat in the range of temperature that is lower than temperature corresponding to the main heating operation. The heating operation of the heater included in the pre-set conditions for operating the driving device 60 by using the controller 70 may be a main heating operation.

The case where the pre-set conditions include the combination of the cumulative time of heating operations of the heater and the heating temperature of the heater may be more useful when the heating operation of the heater includes the main heating operation and the pre-heating operation. For example, when the time at which the aerosol passes through the second material 22 included in one of the chambers 21 and flavors may be provided to the aerosol is pre-set to n minutes, the controller 70 may count the cumulative time of heating operations of the heater only when the heating temperature of the heater reaches the temperature corresponding to the main heating operation.

The pre-set conditions for changing the relative positions of the first cartridge 10 and the second cartridge 20 by operating the driving device 60 by using the controller 70 may include any one of the number of puff operations determined based on the signal detected by the puff sensor 79*p* and the cumulative time of puff operations or a combination thereof. When the intensity of the signal detected by the puff sensor 79*p* exceeds a pre-set threshold value, the controller 70 may determine that a valid inhalation operation has been performed by the user and may count the number of puff operations.

When the pre-set conditions include the number of puff operations, the controller 70 may count the number of puff operations performed on the chamber through which the aerosol currently passes, among the chambers 21 of the second cartridge 20, based on the signal generated by the puff sensor 79*p*. In this case, the controller 70 may simply count only the number of puff operations that have occurred based on the signal of the puff sensor 79*p*, ignoring the cumulative time of puff operations in which the user continuously performs the inhalation operation of inhaling the aerosol.

For example, when the number of puff operations, in which the aerosol passes through the second material 22 included in one of the chambers 21 of the second cartridge 20 and flavors may be provided to the aerosol, is pre-set to m times, the controller 70 may determine that, when the number of puff operations reaches m times, the use of the chamber through which the aerosol currently passes needs to be ended, thereby changing the relative position of the second cartridge 20 with respect to the first cartridge 10 and selecting a new chamber through which the aerosol passes from among the chambers 21.

The controller 70 may determine a position changing time of the second cartridge 20 for selecting a new chamber considering the use environment of the aerosol generating device or the user's inhalation habit. To this end, the pre-set conditions may include the cumulative time of puff operations or a combination of the number of puff operations and the cumulative time of puff operations.

The operation when the pre-set conditions include the combination of the number of puff operations and the cumulative time of puff operations may be as follows. For example, when the number of puff operations, in which the aerosol passes through the second material 22 included in one of the chambers 21 and flavors may be provided to the aerosol, is m times and the cumulative time of puff operations is pre-set to p minutes, the controller 70 may determine that, when all of the condition that the number of puff operations reaches m times and the condition that the cumulative time of puff operations reaches p minutes are satisfied, the use of the chamber through which the aerosol currently passes needs to be ended. Thus, even if the number of puff operations reaches m times based on the signal of the puff sensor 79*p*, when the cumulative time of puff operations has not reached p minutes, the controller 70 may maintain the position of the chamber through which the aerosol currently passes until the cumulative time of puff operations reaches p minutes, so that the number of puff operations may reach (m+x) times. Even when these operating conditions are changed and any one of the condition that the number of puff operations reaches m times and the condition that the cumulative time of puff operations reaches p minutes is satisfied, the controller 70 may determine that the use of the chamber through which the aerosol currently passes needs to be ended.

The pre-set condition for changing the relative positions of the first cartridge 10 and the second cartridge 20 by operating the driving device 60 by using the controller 70 may include a usage time determined based on an input signal generated when the input device 95 receives the user's input.

The case where the pre-set condition includes the usage time determined based on the input signal of the input device 95, may be more useful when the user may perform a function of directly initiating the operation of the heater. For example, when the user manipulates the input device 95 as the user desires or the user's convenience or improving convenience, the aerosol generating device may provide a function in which the heater of the atomizer does not perform a separate pre-heating operation but the heater reacts immediately, thereby performing a main heating operation at a high speed. In this case, the pre-set condition includes the usage time determined based on the input signal of the input device 95, so that, when the usage time at which the atomizer operates reaches a pre-set reference usage time by the user's manipulation, the controller 70 may determine to end the use of the usage chamber through which the aerosol currently passes, thereby changing the relative position of the second cartridge 20 with respect to the first cartridge 10 and selecting a new chamber through which the aerosol passes from among the chambers 21.

The pre-set condition for changing the relative positions of the first cartridge 10 and the second cartridge 20 by operating the driving device 60 by using the controller 70 may include any one of the number of puff operations determined based on the signal detected by the puff sensor 79*p* and the cumulative time of puff operations, or a combination thereof. When the intensity of the signal detected by the puff sensor 79*p* exceeds a pre-set threshold value, the controller 70 may determine that a valid inhalation operation has been performed by the user, and may count the number of puff operations.

In the above description, characters such as m, n, p, and x to indicate time or number of times may refer to integers, real numbers, or length of time.

The pre-set condition for changing the relative positions of the first cartridge 10 and the second cartridge 20 by operating the driving device 60 with the controller 70 may include a selection condition that at least one of the chambers 21 is selected to be used, based on the input signal generated when the input device 95 receives the user's input.

The chambers 21 of the second cartridge 20 may include the second material 22 having different types of mediums or different particle sizes, and the controller 70 may control the display lamp 7*d* to emit light or change an emission color, or display information on the display device 7*f*, thereby providing information on the second material 22 included in the usage chamber, among the chambers 21 of the second cartridge 20, that is aligned with the position of the delivery hole 11 of the first cartridge 10 and used to pass the aerosol to the user.

When the user manipulates the input device 95 to select a desired chamber to be used from among the chambers 21, the controller 70 may determine that the selection condition that the user selects at least one of the chambers 21 based on the input signal input from the input device 95 is achieved, thereby changing the relative positions of the first cartridge 10 and the second cartridge 20.

When using the aerosol generating device described above, the user rotates the second cartridge 20 relative to the first cartridge 10 before mounting the aerosol generating assembly 5 on the case 7, thereby adjusting the rotation position of the second cartridge 20 so that the position of at least one of the chambers 21 of the second cartridge 20 coincides with a position corresponding to the delivery hole 11 of the first cartridge 10. After adjusting the relative positions of the first cartridge 10 and the second cartridge 20, the user may mount the aerosol generating assembly 5 on the case 7.

It is possible to modify this operating method. That is, when the user mounts the aerosol generating assembly 5 on the case 7 without needing to adjust the relative positions of the first cartridge 10 and the second cartridge 20, the driving device 60 embedded in the case 7 may automatically rotate the second cartridge 20 to automatically adjust the relative positions of the first cartridge 10 and the second cartridge 20 to an initial position for generating an aerosol. The 'initial position' may be a position corresponding to a position in which the position of any one of the chambers 21 of the second cartridge 20 corresponds to the position of the delivery hole 11.

In a state in which the position of at least one of the chambers 21 of the second cartridge 20 corresponds to the position of the delivery hole 11 of the first cartridge 10, the user may inhale the aerosol through the mouthpiece 26.

The aerosol generating assembly 5 of the aerosol generating device may be handled as one device in which the first cartridge 10 for accommodating the first material 12 and the second cartridge 20 for accommodating the second material 22 are integrated with each other, and thus is convenient to carry and use.

In addition, even when the first cartridge 10 of the aerosol generating device is designed to accommodate a large amount of the first material 12, the second cartridge 20 may be automatically rotated by the driving device 60 to select the chambers 21 used for supplying the aerosol, so that the effect of replacing the second cartridge including the second material 22 with a new second material 22 may be obtained without replacing the second cartridge including the second material 22.

In addition, the chambers 21 of the second cartridge 20 may include different types of second materials 22. For example, the chambers 21 may include the second material 22 having different particle sizes or different flavors. Even when the chambers 21 include different types of second materials 22, the controller 70 may identify the usage chamber, among the chambers 21, currently in use to pass the aerosol by being aligned to correspond to the delivery hole 11 based on a signal generated by the position sensor 97. Because information on the usage chamber identified by the controller 70 and on the second material 22 included in the usage chamber may be provided to the user, the user may select one from among the chambers 21 to select a desired second material 22, thereby freely enjoying the aerosol having various flavors.

Figure 5:
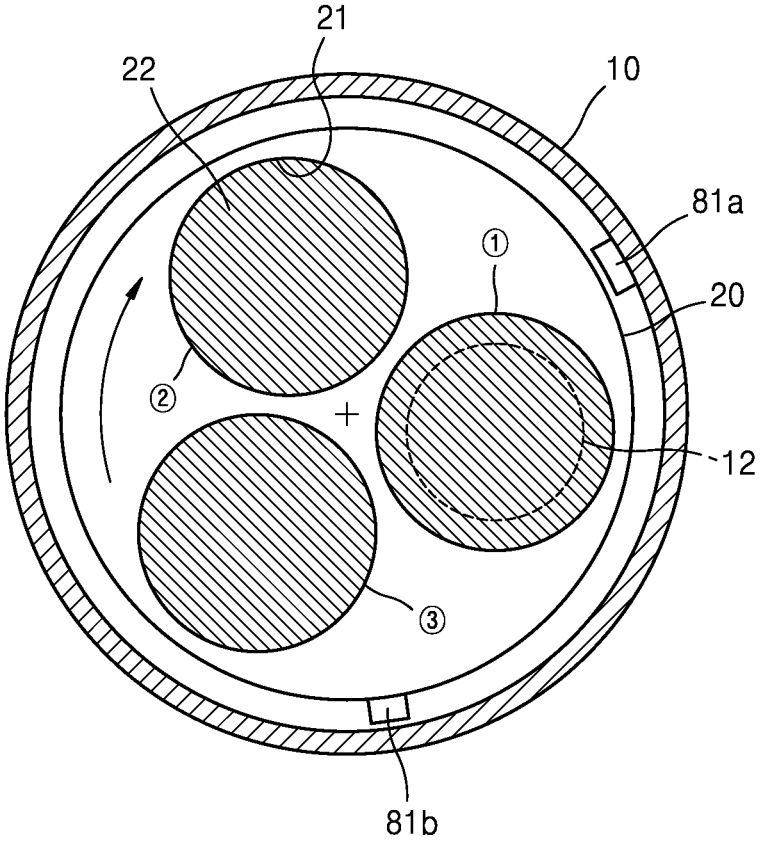
FIG. 5 is a cross-sectional view schematically illustrating an operating state of an aerosol generating device according to another embodiment.
Figure 6:
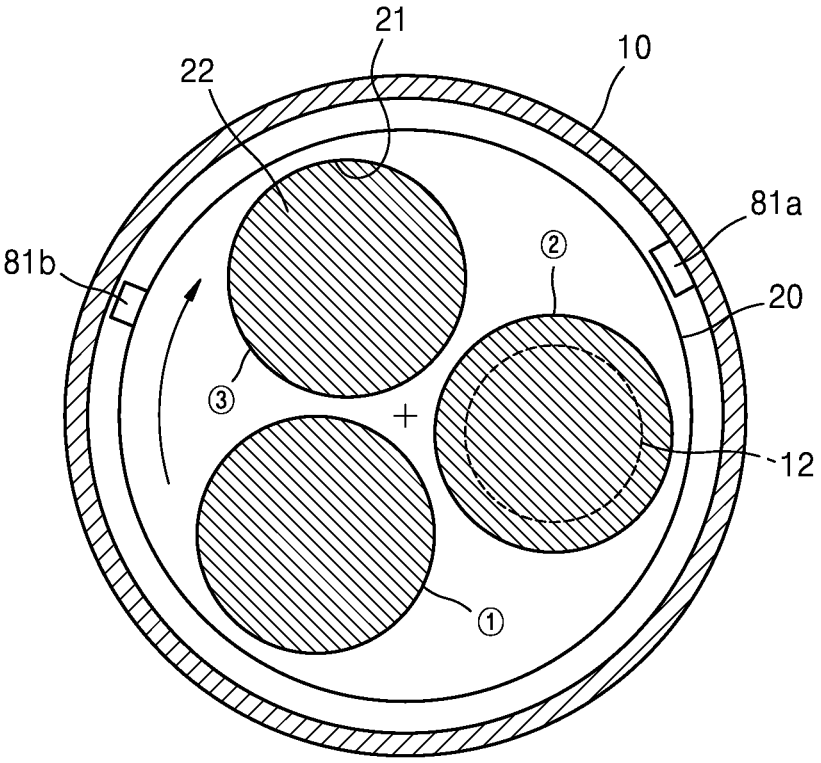
FIG. 6 is a cross-sectional view schematically illustrating another operating state of the aerosol generating device according to the embodiment shown in FIG. 5.
Figure 7:
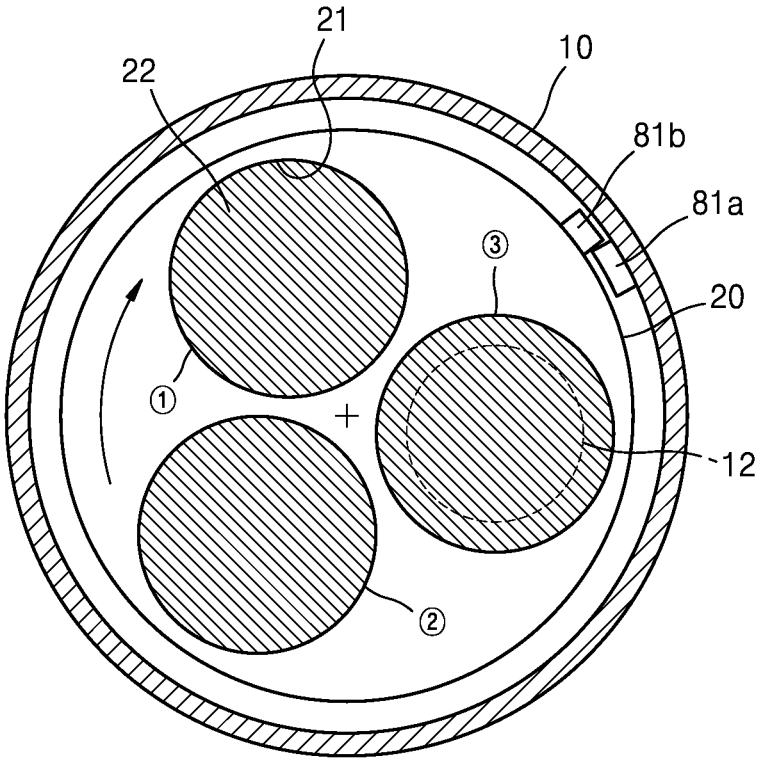
FIG. 7 is a cross-sectional view schematically illustrating another operating state of the aerosol generating device according to the embodiment shown in FIG. 5.

FIG. 5 is a cross-sectional view schematically illustrating an operating state of an aerosol generating device according to another embodiment, FIG. 6 is a cross-sectional view schematically illustrating another operating state of the aerosol generating device according to the embodiment shown in FIG. 5, and FIG. 7 is a cross-sectional view schematically illustrating another operating state of the aerosol generating device according to the embodiment shown in FIG. 5.

In the aerosol generating device according to the embodiment shown in FIGS. 5 through 7, the stoppers 81*a* and 81*b* may be arranged on the movement path of the chambers 21 between the first cartridge 10 and the second cartridge 20. Each of the chambers 21 may have a unique identification number of 1, 2, and 3. As the second cartridge 20 makes a rotational motion with respect to the first cartridge 10 maintained in a fixed position, one of the chambers 21 may perform a function of the usage chamber that is aligned with respect to the position of the delivery hole 11 of the first cartridge 10 and passes the aerosol.

In FIG. 5, the chamber with the identification number 1 may be aligned with respect to the delivery hole 11, and in FIG. 6, the chamber with the identification number 2 may be aligned with respect to the delivery hole 11, and in FIG. 7, the chamber the chamber with the identification number 3 may be aligned with respect to the delivery hole 11. When, in the state shown in FIG. 7, the second cartridge 20 further rotates in a clockwise direction with respect to the first cartridge 10, the stoppers 81*a* and 81*b* are in contact with each other in a limit position, so that the second cartridge 20 may not further rotate with respect to the first cartridge 10.

The use of the stoppers 81*a* and 81*b* by a physical method, whereby the stoppers 81*a* and 81*b* are in contact with each other to limit the rotational motion of the second cartridge 20, may be more advantageous when there is no encoder or origin sensor for detecting the rotation position of the motor. For example, even when the driving device for rotating the second cartridge 20 includes a stepping motor that operates based on a pulse signal and an origin sensor for setting a reference position of the stepping motor is not installed, the reference position of the stepping motor may be reset by using the stoppers 81*a* and 81*b*.

Because the controller may identify the positions of the chambers 21 aligned with respect to the delivery hole 11 based on the signal of the position sensor, in a state in which the chamber having the identification number of 3 is aligned with respect to the delivery hole 11, the controller 70 may apply the pulse signal to the stepping motor so as to rotate the second cartridge 20 up to the limit position where the stoppers 81*a* and 81*b* contact each other.

In order to realize this operation, the controller 70 may calculate the length of a pre-set pulse signal until the chamber having the identification number of 3 reaches the limit position of the stoppers 81*a* and 81*b* from the position aligned with the delivery hole 11 or may obtain the length of the pre-set pulse signal from data stored in the storage. The length of the pre-set pulse signal, until the chamber having the identification number of 3 reaches the limit position of the stoppers 81*a* and 81*b* from a position in which the chamber with the identification number of 3 is aligned with the delivery hole 11, may be set to be greater than the length of the pulse signal for achieving an actual rotational motion until the chamber having the identification number of 3 reaches the limit position of the stoppers 81*a* and 81*b* from the position in which the chamber with the identification number of 3 is aligned with the delivery hole 11.

Figure 8:
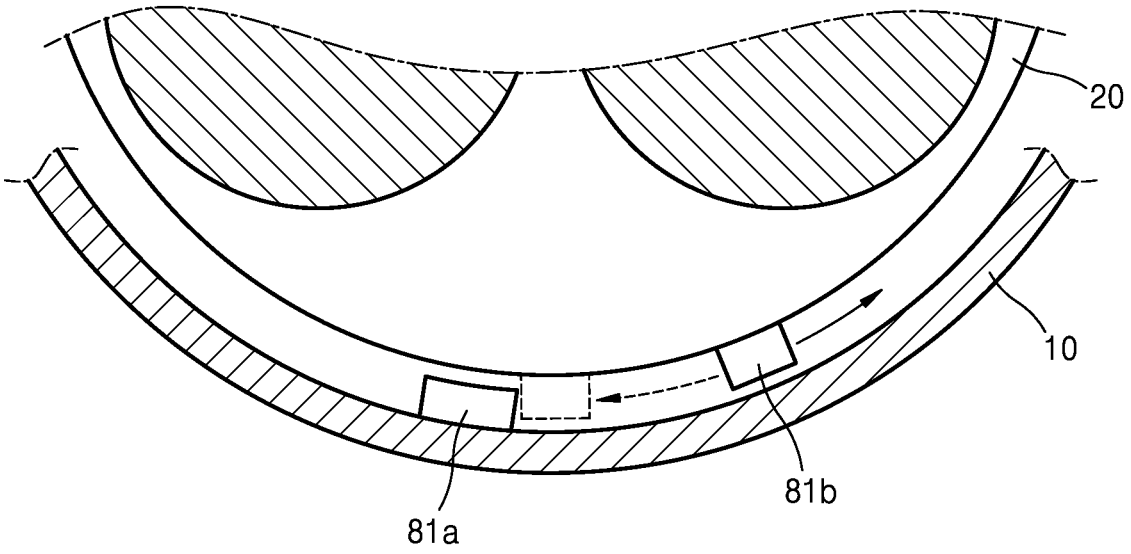
FIG. 8 is an enlarged cross-sectional view of a portion of the aerosol generating device shown in FIG. 7.

FIG. 8 is an enlarged cross-sectional view illustrating a portion of the aerosol generating device shown in FIG. 7.

When the controller 70 applies the pre-set pulse signal to the stepping motor at a position where the chamber with the identification number of 3 is aligned with the delivery hole 11, even after the stoppers 81*a* and 81*b* are in contact with each other at the limit position, the stepping motor is further operated by a signal applied from the controller 70 and the second cartridge 20 may be in a stopped state after attempting to further perform the rotational motion. In this state, the controller 70 may convert the rotational motion of the second cartridge 20 into an opposite direction. Referring to FIG. 8, the second cartridge 20 may rotate in a clockwise direction until the stoppers 81*a* and 81*b* are in contact with each other at the limit position, as indicated by a dotted line, and then the motion direction of the second cartridge 20 may be converted into a counterclockwise direction, as indicated by a solid line, so that the second cartridge 20 may continue to rotate.

The controller 70 may rotate the second cartridge 20 until the stoppers 81*a* and 81*b* are in physical contact with each other from the state where the chamber closest to the stoppers 81*a* and 81*b* is aligned to correspond to the delivery hole 11. In order for the stoppers 81*a* and 81*b* to reliably contact each other, the controller 70 may transmit a signal to the motor so as to rotate the second cartridge 20 in a range of rotational angles greater than an 'expected rotational angle' required for the rotational motion of the second cartridge 20. The 'expected rotational angle' of the second cartridge 20 required until the stoppers 81*a* and 81*b* contact each other may be set according to the rotation direction of the second cartridge 20 based on the size of the second cartridge 20 (e.g. the diameter of the second cartridge 20). Because the controller 70 may rotate the second cartridge 20 with the rotational angle in the range of rotational angles greater than the 'expected rotational angel', the stoppers 81*a* and 81*b* may be reliably in physical contact with each other.

Figure 9:
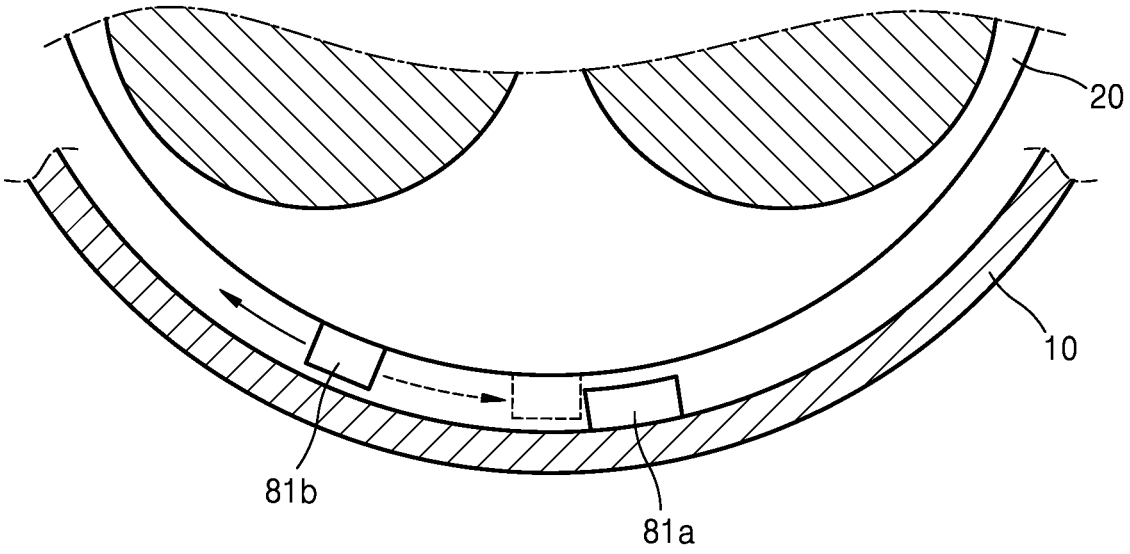
FIG. 9 is an enlarged cross-sectional view illustrating another operating state of the aerosol generating device shown in FIG. 7.

FIG. 9 is an enlarged cross-sectional view illustrating another operating state of the aerosol generating device shown in FIG. 7.

In FIG. 9, the second cartridge 20 makes a rotational motion in a counterclockwise direction with respect to the first cartridge 10. After the second cartridge 20 continues to rotate in a counterclockwise direction and the stoppers 81*a* and 81*b* contact each other as shown by the dotted line, the motion direction of the second cartridge 20 may be converted into a clockwise direction that is an opposite direction so that the second cartridge 20 may continue to rotate.

Figure 10:
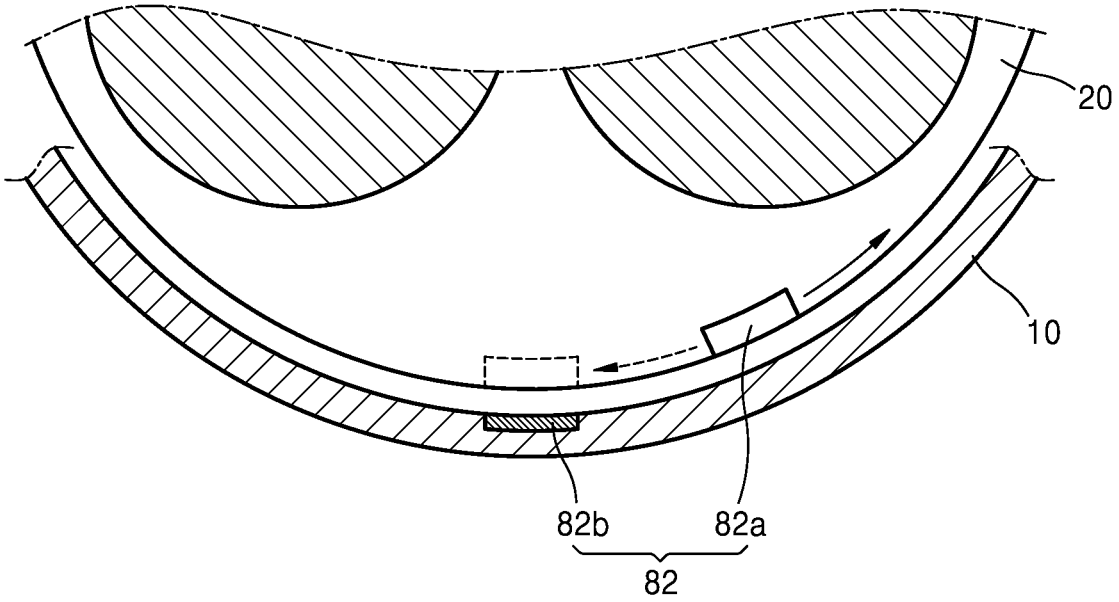
FIG. 10 is a cross-sectional view schematically illustrating an operating state of an aerosol generating device according to another embodiment.

FIG. 10 is a cross-sectional view schematically illustrating an operating state of an aerosol generating device according to another embodiment.

In the aerosol generating device according to the embodiment shown in FIG. 10, the second cartridge 20 may rotate with respect to the first cartridge 10 maintained in a fixed position so that the relative positions of the chambers with respect to the delivery hole may be changed. A reference sensor 82 that functions as an electronic stopper in relation to the relative rotational motion of the first cartridge 10 and the second cartridge 20 may be installed between the first cartridge 10 and the second cartridge 20.

The reference sensor 82 may be arranged on a movement path of the chambers between the first cartridge 10 and the second cartridge 20 and may perform a function of limiting the range of the rotational motion for changing the relative positions of the first cartridge 10 and the second cartridge 20.

The reference sensor 82 may include a reference signal transmitter 82*a* and a reference signal receiver 82*b*. The reference sensor 82 may be implemented using various units such as an optical sensor, an ultrasonic sensor, a hall sensor using a magnet and a hall effect, an electrical switch that generates a signal by physical contact, and the like.

The controller 70 may limit the range of the rotational motion of the second cartridge 20 with respect to the first cartridge 10 based on a signal generated by the reference sensor 82. For example, as shown in FIG. 10, when the second cartridge 20 rotates in a clockwise direction with respect to the first cartridge 10 and the reference sensor 82 generates a signal, the controller 70 may determine that the second cartridge 20 reaches the limit of the clockwise rotation range and may convert the rotation direction of the second cartridge 20 into a counterclockwise direction. When the second cartridge 20 rotates in the counterclockwise direction and the reference sensor 82 generates a signal, the controller 70 may determine that the second cartridge 20 reaches the limit in the rotational range in the counterclockwise direction and may convert the rotation direction of the second cartridge 20 into the clockwise direction.

When the stoppers 81*a* and 81*b* or the reference sensor 82 having the above-described configurations is used, the second cartridge 20 may not continue to rotate with respect to the first cartridge 10, and the rotation direction of the second cartridge 20 may be converted in the range within 360 degrees. Thus, even when the rotational motion of the second cartridge 20 with respect to the first cartridge 10 is repeatedly performed, because a phenomenon, that errors related to identification of the relative positions of the first cartridge 10 and the second cartridge 20 are accumulated, may be minimized so that the positions of the chambers 21 may be precisely controlled.

Figure 11:
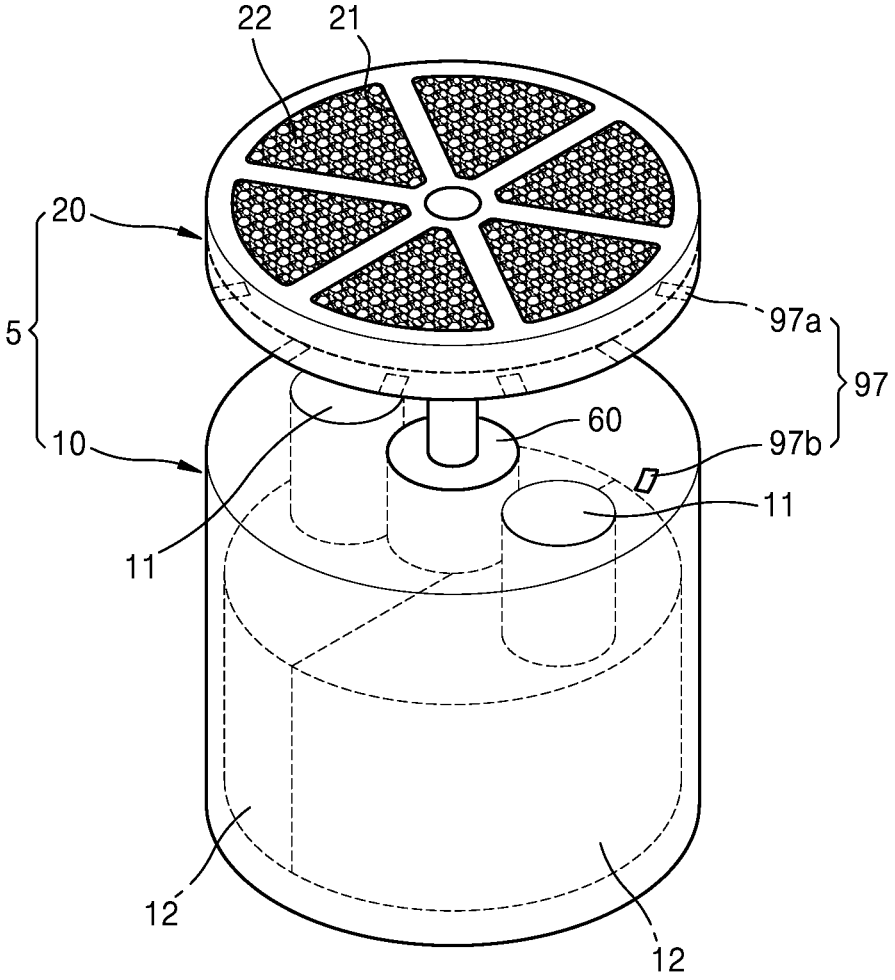
FIG. 11 is a perspective view schematically illustrating some components of an aerosol generating device according to another embodiment.

FIG. 11 is a perspective view schematically illustrating some components of an aerosol generating device according to another embodiment.

In the aerosol generating device according to the embodiment shown in FIG. 11, an aerosol generating assembly 5 may include a first cartridge 10 and a second cartridge 20 that is rotatably coupled to the first cartridge 10. A driving device 60 may be installed in the first cartridge 10, and the driving device 60 may rotate the second cartridge 20 so that the relative positions of the second cartridge 20 with respect to the first cartridge 10 may be changed.

The first cartridge 10 may include a plurality of reservoirs partitioned to accommodate a plurality of first materials 12, respectively, and a plurality of delivery holes 11 formed to correspond to the plurality of reservoirs. In the aerosol generating device according to the embodiment shown in FIG. 11, the first cartridge 10 includes two reservoirs and two delivery holes 11. However, embodiments of the present disclosure are not limited by the configuration of the first cartridge 10, and the number of reservoirs and the number of delivery holes 11 may be variously changed.

An aerosol generated when the first material 12 contained in the plurality of reservoirs is vaporized, may be delivered to the second cartridge 20 through the plurality of delivery holes 11 of the first cartridge 10. When the aerosol is generated in the first cartridge 10, the first materials 12 of all reservoirs of the first cartridge 10 may be simultaneously vaporized. According to embodiments, the first material 12 may be vaporized in only one of the plurality of reservoirs, or the first material 12 may be vaporized in more than one of the plurality of reservoirs.

The second cartridge 20 may include a plurality of chambers 21 for accommodating the second material 22 through which the aerosol delivered from the first cartridge 10 passes and is discharged to the outside. The first cartridge 10 and the second cartridge 20 may be integrated with each other and integrally coupled to each other to be handled as one part, thereby forming the aerosol generating assembly 5.

A position sensor 97 for generating a position signal by detecting the position of at least one of the chambers 21 with respect to the delivery hole 11 may be installed between the first cartridge 10 and the second cartridge 20.

The position sensor 97 may include transmitters 97*a* apart from each other in a rotation direction of the second cartridge 20, i.e., in a circumferential direction, and a receiver 97*b* that is arranged in the first cartridge 10 and detects the transmitters 97*a*. Embodiments of the present disclosure are not limited by the arrangement positions or the number of transmitters 97*a* and the receivers 97*b*. For example, the transmitters 97*a* may be arranged in the first cartridge 10, and the receivers 97*b* may be arranged in the second cartridge 20.

In FIG. 11, each of transmitters 97*a* may be arranged at a position corresponding to each of the chambers 21 of the second cartridge 20, and additional transmitters 97*a* may also be arranged at a position between the adjacent chambers 21. The transmitters 97*a* corresponding to each of the chambers 21 of the second cartridge 20 among the plurality of transmitters 97*a* may generate a signal indicating that the corresponding chamber is individually aligned with the position of the delivery hole 11. Also, the transmitters 97*a* arranged between the adjacent chambers 21 may generate a signal indicating that adjacent chambers 21 are simultaneously aligned with the position of the delivery hole 11 and that the adjacent chambers 21 perform a function of a usage chamber through which the aerosol passes.

Embodiments of the present disclosure are not limited by the arrangement positions and the number of transmitters 97*a* of the position sensor 97. For example, transmitters 97*a* may be arranged to correspond only to each of the chambers 21.

Figure 12:
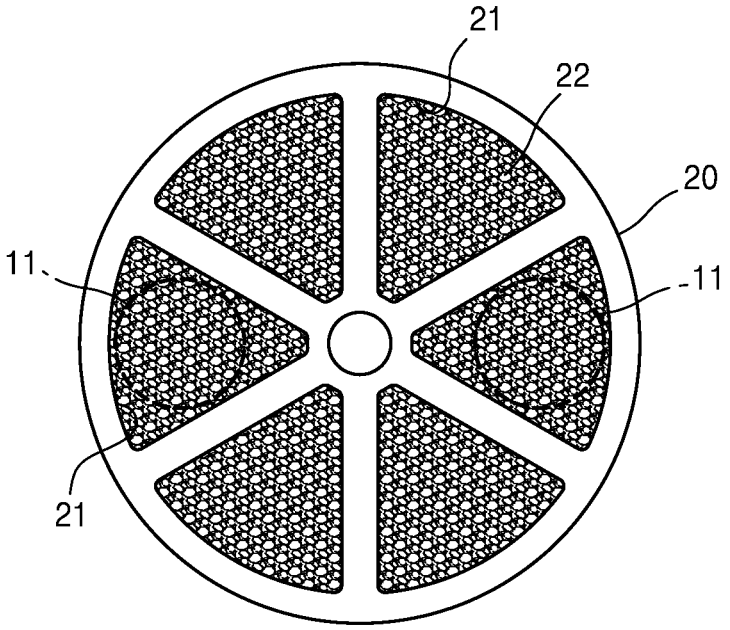
FIG. 12 is a latitudinal cross-sectional view illustrating an operating state of the aerosol generating device according to the embodiment shown in FIG. 11.

FIG. 12 is a latitudinal cross-sectional view illustrating an operating state of the aerosol generating device according to the embodiment shown in FIG. 11.

The second cartridge 20 may rotate by the driving device 60 so that the relative positions of the second cartridge 20 with respect to the first cartridge 10 may be changed. As shown in FIG. 12, the rotation position of the second cartridge 20 with respect to the first cartridge 10 may be aligned so that the position of one of the chambers 21 of the second cartridge 20 may correspond to the position of one delivery hole 11. In the aligned state shown in FIG. 12, one of the chambers 21 of the second cartridge 20 passes the aerosol delivered from the one delivery hole 11 of the first cartridge 10 so that the function of the usage chamber for changing the characteristics of the aerosol may be performed.

Figure 13:
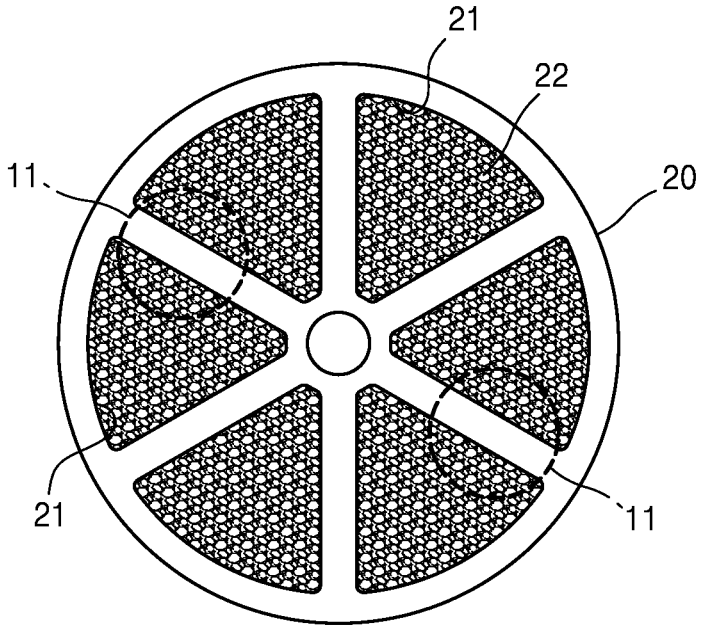
FIG. 13 is a latitudinal cross-sectional view illustrating another operating state of the aerosol generating device according to the embodiment shown in FIG. 11.

FIG. 13 is a latitudinal cross-sectional view illustrating another operating state of the aerosol generating device according to the embodiment shown in FIG. 11.

The second cartridge 20 may rotate by the driving device so that, when the relative positions of the second cartridge 20 with respect to the first cartridge 10 is changed, as shown in FIG. 13, the rotation position of the second cartridge 20 with respect to the first cartridge 10 may be aligned so that the position of the adjacent chambers 21 may correspond to the position of one delivery hole 11.

In FIG. 13, each of two adjacent chambers among the chambers 21 of the second cartridge 20 may be positioned to overlap a region corresponding to half of one delivery hole 11. Embodiments of the present disclosure are not limited by the alignment position of the second cartridge 20. The rotation position of the second cartridge 20 with respect to the first cartridge 10 may be aligned so that the areas in which two adjacent chambers of the chambers 21 overlap the delivery hole 11 may be different from each other.

For example, when the life associated with the function of passing the aerosol through the second material 22 contained in one of the two adjacent chambers 21 reaches 20%, one of the two adjacent chambers 21 may overlap an area corresponding to about 80% of the delivery hole 11, and the other of the two adjacent chambers 21 may overlap an area corresponding to about 20% of the delivery hole 11.

For example, when the life associated with the function of passing the aerosol through the second material 22 contained in one of the two adjacent chambers 21 reaches 60%, one of the two adjacent chambers 21 may overlap an area corresponding to about 40% of the delivery hole 11, and the other of the two adjacent chambers 21 may overlap an area corresponding to about 60% of the delivery hole 11.

Also, when the life associated with the function of passing the aerosol through the second material 22 contained in one of the two adjacent chambers 21 reaches 80%, one of the two adjacent chambers 21 may overlap an area corresponding to about 20% of the delivery hole 11, and the other of the two adjacent chambers 21 may overlap an area corresponding to about 80% of the delivery hole 11.

The life associated with the function of passing the aerosol through the second material 22 contained in one of the two adjacent chambers 21 of the second cartridge 20 may be considered to determine a pre-set condition used to change the relative positions of the first cartridge 10 and the second cartridge 20 by using the controller, as described above.

Also, as described above, when the area in which the adjacent chambers 21 overlap the delivery hole 11 by rotating the second cartridge 20 considering the life of the second material 22 of the chambers 21, the second cartridge 20 may be intermittently moved according to a change of time, or the second cartridge 20 may be continuously moved according to a change of time.

As illustrated in FIG. 13, according to a method of aligning the position so that adjacent chambers among the plurality of chambers 21 of the second cartridge 20 overlaps one delivery hole 11, an operation of flowing the aerosol without stopping the operation of generating an aerosol in the first cartridge and delivering the generated aerosol to the second cartridge 20 while the second cartridge 20 rotates with respect to the first cartridge 10 may be continuously maintained.

Also, the relative positions of the first cartridge 10 and the second cartridge 20 may be changed so that a chamber through which the aerosol passes may be sequentially selected from among the plurality of chambers 21. When the second cartridge 20 rotates by selecting a chamber through which the aerosol passes from among the plurality of chambers 21, the position of the previous chamber through which the aerosol currently passes may not immediately depart from the delivery hole 11, and an operation of passing the aerosol through the previous chamber and a subsequent chamber simultaneously, which are subsequently aligned with the position of the delivery hole 11 due to the rotational motion of the second cartridge 20 may be performed.

According to this operating method, while the relative positions of the first cartridge 10 and the second cartridge 20 are changed, characteristics such as temperature, humidity and flavor of the aerosol delivered to the user do not change rapidly, so that a steady and stable supply of an aerosol is possible.

Also, when each of the plurality of chambers 21 of the second cartridge 20 includes the second material 22 having different characteristics, the aerosol may pass through the adjacent chambers so that the characteristics such as ingredients and flavors of the aerosol may be changed so that various types of aerosols may be provided to the user.

Figure 14:
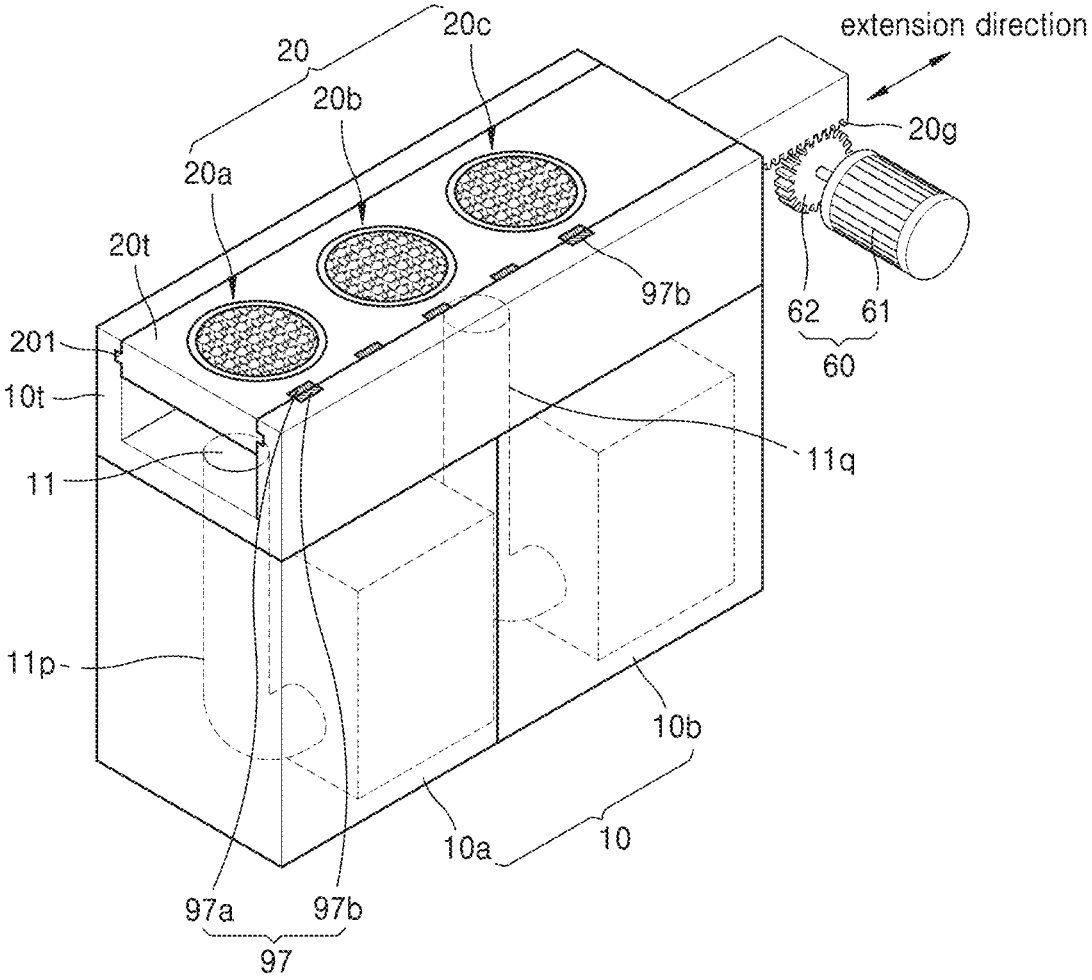
FIG. 14 is a perspective view schematically illustrating some components of an aerosol generating device according to another embodiment.

FIG. 14 is a perspective view schematically illustrating some components of an aerosol generating device according to another embodiment.

The aerosol generating device according to the embodiment shown in FIG. 14 may include a first cartridge 10 including reservoirs 10*a* and 10*b* that are partitioned independently from each other to accommodate a first material, a second cartridge 20 that is coupled to the first cartridge 10 to be movable linearly, and a driving device 60 that linearly moves the second cartridge 20.

The first cartridge 10 may include passages 11*p* and 11*q* through which the aerosol generated by being vaporized from the first material accommodated in each of the reservoirs 10*a* and 10*b* is delivered, and a delivery hole 11 formed in an end of each of the passages 11*p* and 11*q*.

The first cartridge 10 may include a linear guide 10*t* that extends linearly around an upper portion of the delivery hole 11, and the second cartridge 20 may include a rail 201 that is slidably coupled to the linear guide 10*t*. The second cartridge 20 may move linearly along the extension direction of the linear guide 10*t* of the first cartridge 10. The second cartridge 20 may include a main body 20*t* that is plate-shaped and that extends long along the extension direction of the linear guide 10*t*, and a plurality of chambers 20*a*, 20*b*, and 20*c*, which are sequentially apart from each other along the extension direction of the main body 20*t*.

In the embodiment show in FIG. 14, two reservoirs 10*a* and 10*b* are arranged, and three chambers 20*a*, 20*b*, and 20*c* are arranged. However, the number of reservoirs and the number of chambers may be variously changed.

The aerosol generating device may include a driving device 60 for generating a driving force to move at least one of the first cartridge 10 and the second cartridge 20. The driving device 60 may include a motor 61 operated by an electrical signal, and a gear 62 that transmits the driving force of the motor 61 to the second cartridge 20. A gear surface 20*g* may be installed at one side of the main body 20*t* of the second cartridge 20.

In FIG. 14, the driving device 60 is shown as an electric motor for generating a rotational force for rotating the gear 62. However, embodiments of the present disclosure are not limited by the type of the driving device 60. For example, the driving device 60 may include a permanent magnet linearly arranged, a linear motor positioned to correspond to the permanent magnet and including an electromagnet having an electric coil, or a cylinder using the pressure of a fluid.

As the second cartridge 20 is linearly moved, the position of any one or adjacent chambers of the chambers 20*a*, 20*b*, and 20*c* of the second cartridge 20 may be aligned to correspond to the position of one delivery hole 11. Also, the position of one group among the chambers 20*a*, 20*b*, and 20*c* of the second cartridge 20 may be aligned to correspond to the position of one of the two delivery holes 11, and simultaneously, the position of another group among the chambers 20*a*, 20*b*, and 20*c* may be aligned to correspond to the position of the other one of the two delivery holes 11.

A position sensor 97 that generates a signal by detecting the position of at least one of the chambers 20*a*, 20*b*, and 20*c* with respect to the delivery hole 11 may be installed between the first cartridge 10 and the second cartridge 20.

The position sensor 97 may include transmitters 97*a* that are apart from each other along the direction of the linear motion of the second cartridge 20 in the second cartridge 20, and receivers 97*b* that are arranged in the first cartridge 10 and detect the transmitters 97*a*. Embodiments of the present disclosure are not limited by the arrangement positions or the number of transmitters 97*a* and receivers 97*b*. For example, the transmitters 97*a* may be arranged in the first cartridge 10, and the receivers 97*b* may be arranged in the second cartridge 20.

The transmitters 97*a* and the receivers 97*b* of the position sensor 97 may be implemented by an optical sensor such as a photocoupler, a magnetic sensor that detects a magnetism by using a hall effect, an electric resistance sensor that detects changes in electric resistance, a switch that generates a signal according to a physical contact, or a combination thereof.

Figure 15:
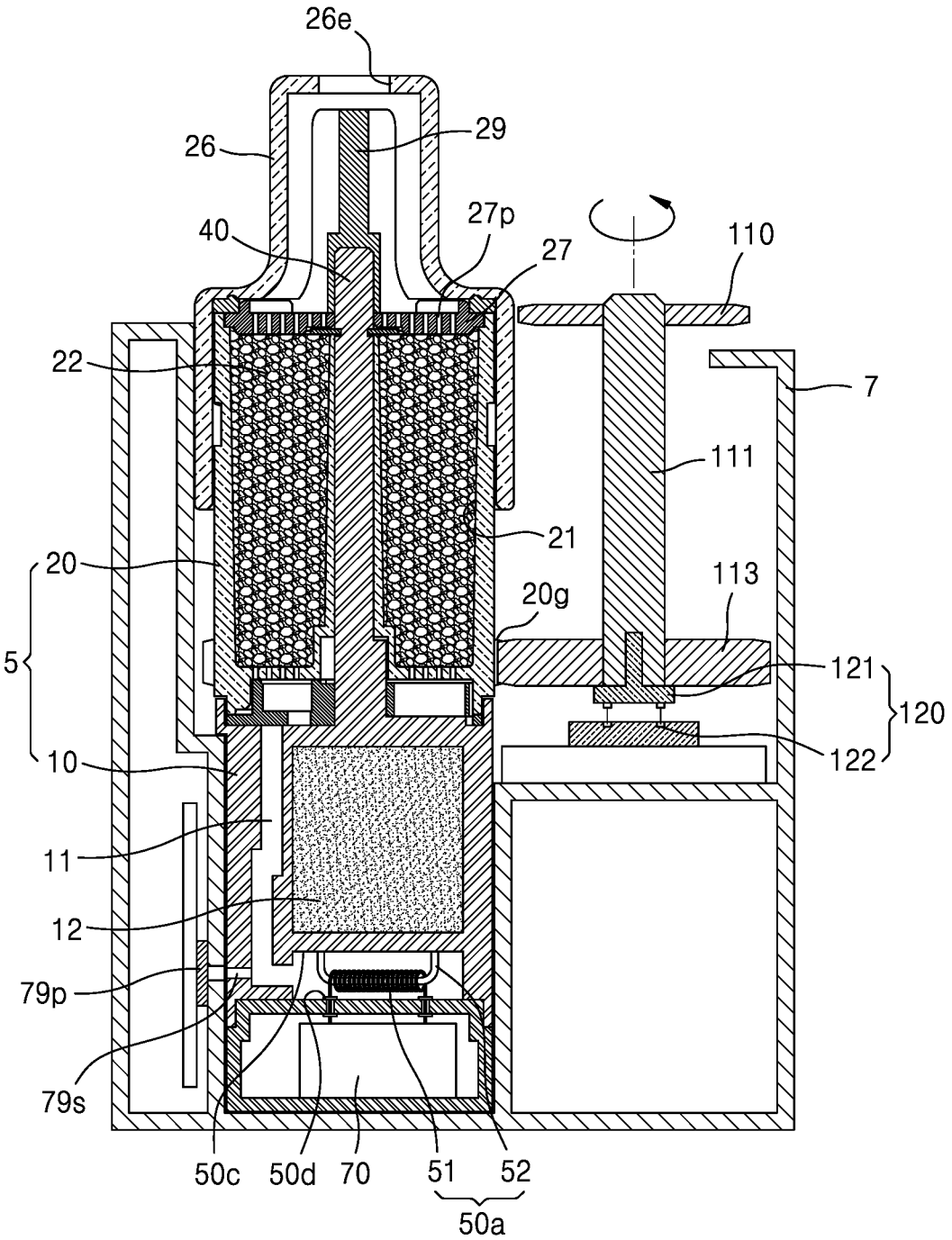
FIG. 15 is a longitudinal cross-sectional view schematically illustrating an aerosol generating device according to another embodiment.

FIG. 15 is a longitudinal cross-sectional view schematically illustrating an aerosol generating device according to another embodiment. The aerosol generating device according to the embodiment shown in FIG. 15 is similar to the aerosol generating device according to the embodiment shown in FIGS. 1 through 3.

The aerosol generating device according to the embodiment shown in FIG. 15 may include a handle 110 that may be manually operated by the user by replacing a driving device such as a motor so as to change the relative positions of the first cartridge 10 and the second cartridge 20.

The handle 110 may be connected to a handle shaft 111 rotatably installed in the case 7, and a force transmission unit 113 (e.g. at least one gear) that transmits the user's force applied to the handle 110 may be installed in the handle shaft 111. The force transmission unit 113 may be engaged with the gear surface 20*g* installed outside the second cartridge 20 to extend along the rotation direction of the second cartridge 20. Although not shown in FIG. 15 for simplicity, the case 7 may include mechanical elements such as bearings so as to rotatably support the handle shaft 111.

A switch 120 that generates a position signal indicating the position of the chambers 21 according to changes in the relative positions of the second cartridge 20 with respect to the first cartridge 10 may be installed at a lower end of the handle shaft 111 to which the force transmission unit 113 is connected. The switch 120 may be an example of the position sensor.

The switch 120 may include a transmitter 121 installed at a lower end of the handle shaft 111 and a receiver 122 that is arranged inside the case 7 and detects a signal transmitted from the transmitter 121. The installation position of the transmitter 121 may be variously changed, and the transmitter 121 may be arranged at the force transmission unit 113, for example.

The switch 120 may be implemented by one of an optical sensor such as a photocoupler, a magnetic sensor that detects magnetism by using a hall effect, an electric resistance sensor that detects changes in electric resistance, a switch that generates a signal according to a physical contact, or a combination thereof.

Because at least part of the handle 110 is exposed to the outside of the case 7, when the user rotates the handle 110, the user's force may be transmitted to the gear surface 20*g* through the force transmission unit 113 so that the second cartridge 20 may rotate.

In a state in which the position of at least one of the chambers 21 of the second cartridge 20 corresponds to the position of the delivery hole 11 of the first cartridge 10, the user may inhale the aerosol through the mouthpiece 26.

The user may manipulate the handle 110 to rotate the second cartridge 20. While the second cartridge 20 rotates, the controller 70 may perform a function of identifying a 'usage chamber, among the chambers 21, that is aligned to correspond to the position of the delivery hole 11 and is in use to pass the aerosol' based on the signal of the switch 120.

The controller 70 may output and provide information on the usage chamber, among the chambers 21 of the second cartridge 20, that is currently aligned with the position of the delivery hole 11 of the first cartridge 10 and that is used to pass aerosol, to the user through an information generator.

The user may manipulate the handle 110 to rotate the second cartridge 20 and simultaneously may check the information on the usage chamber output by the information generator and then may select a desired chamber to be used among the chambers 21.

Embodiments of the present disclosure are not limited by the connection structure shown in FIG. 15 of the handle 110 for moving the second cartridge 20 and of the second cartridge 20, and the structure of the handle 110 that may be manually manipulated by the user. The connection structure of the handle 110 and the second cartridge 20 may be variously changed. For example, the force transmission unit 113 may not be installed between the handle 110 and the second cartridge 20, and the handle 110 may be directly connected to the gear surface 20*g* of the second cartridge 20 or the handle 110 may be installed on an outer surface of the second cartridge 20.

When the handle 110 is directly connected to the second cartridge 20 or the handle 110 is installed on the second cartridge 20, the switch for generating the position signal indicating the position of the chambers 21 according to changes in the rotation position of the second cartridge 20 may be installed at the handle 110.

Figure 16:
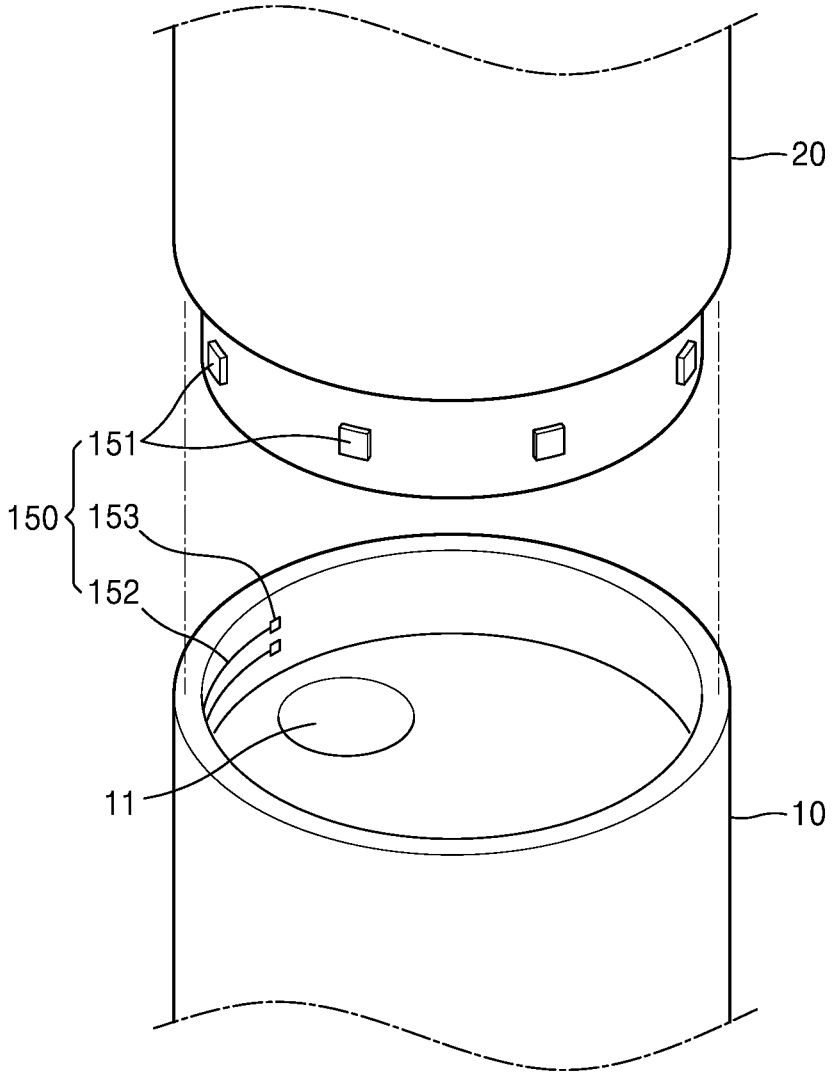
FIG. 16 is a perspective view schematically illustrating a coupling relationship between some components of an aerosol generating device according to another embodiment.

FIG. 16 is a perspective view schematically illustrating a coupling relationship between some components of an aerosol generating device according to another embodiment.

The aerosol generating device according to the embodiment shown in FIG. 16 may include a first cartridge 10 and a second cartridge 20 that are rotatably coupled to each other so that changes in the relative positions thereof are possible. As the position of the rotation direction of the second position with respect to the first cartridge 10 is changed, the position of at least one of the chambers of the second cartridge 20 may be aligned to correspond to the position of the delivery hole 11 of the first cartridge 10.

A position sensor 150 that generates a signal by detecting the position of at least one of the chambers of the second cartridge 20 with respect to the delivery hole 11 may be arranged between the first cartridge 10 and the second cartridge 20.

The position sensor 150 may include a plurality of electric resistors 151 having electric resistance values with different dimensions and a conducting wire 152 that is electrically connectable to the plurality of electric resistors 151. The plurality of electric resistors 151 may be arranged in the second cartridge 20 and may be apart from each other along the rotation direction of the second cartridge 20 with respect to the first cartridge 10. The conducting wire 152 may extend in a circumferential direction along the rotation direction of the second cartridge 20, and connection terminals 153 that are electrically connectable to the electric resistors 151 may be arranged at an end of the conducting wire 152.

While the second cartridge 20 rotates relative to the first cartridge 10, when the plurality of electric resistors 151 of the second cartridge 20 are in contact with the connection terminals 153, electrical connection between the conducting wire 152 and the electric resistors 151 may be made. The surface of the conducting wire 152 may be coated with an electrical insulator so that electrical connection may be made only when the electric resistors 151 are in contact with the connection terminals 153. In a state in which the conducting wire 152 and the electric resistors 151 are not electrically connected to each other through the connection terminals 153, electrical current does not flow through the conducting wire 152. To this end, in a state in which each of the connection terminals 153 and the electric resistors 151 are not connected to each other, an electric circuit of the conducting wire 152 and the connection terminal 153 may constitute an open circuit.

Because the plurality of electric resistors 151 have unique, different electric resistance values, in a state in which the electric resistors 151 and the conducting wire 152 are electrically connected to each other, the magnitude of voltage or the amount of current flowing through the conducting wire 152 may be different according to the electric resistors 151. Thus, the controller may detect the voltage or electrical current flowing through the conducting wire 152 so as to identify the usage chamber, among the chambers of the second cartridge 20, that is aligned with the delivery hole 11 of the first cartridge 10 and is used to pass the aerosol.

Figure 17:
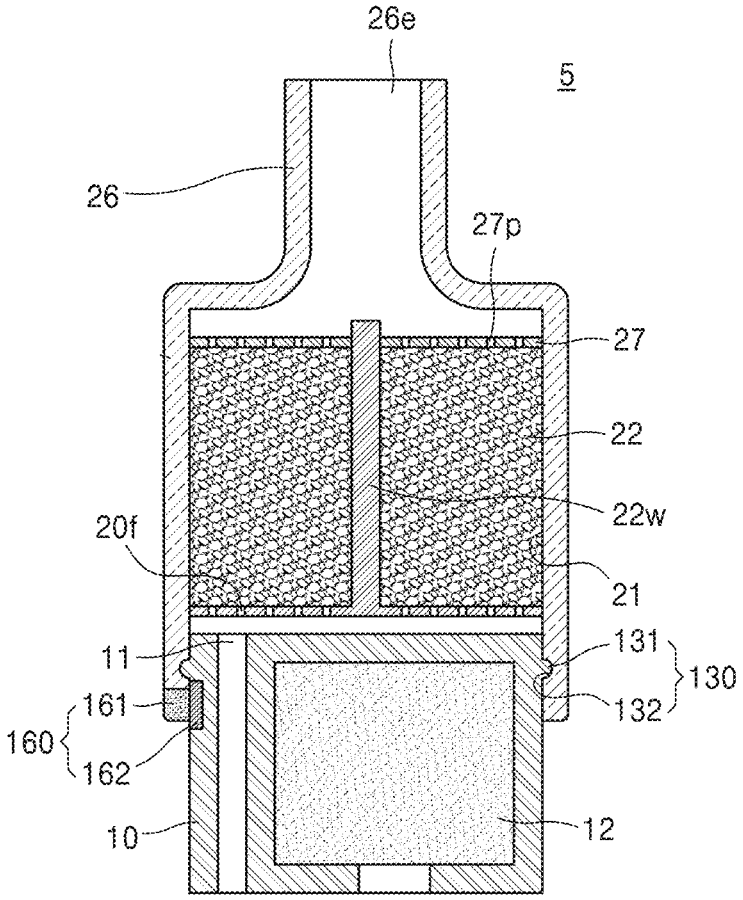
FIG. 17 is a longitudinal cross-sectional view schematically illustrating a coupling relationship between some components of an aerosol generating device according to another embodiment.

FIG. 17 is a longitudinal cross-sectional view schematically illustrating a coupling relationship between some components of an aerosol generating device according to another embodiment.

An aerosol generating assembly 5 of the aerosol generating device according to the embodiment shown in FIG. 17 may include a first cartridge 10 for accommodating a first material 12 for generating an aerosol and a second cartridge 20 arranged to rotate with respect to the first cartridge 10.

The second cartridge 20 may include a plurality of chambers 21 for accommodating a second material 22 through which the aerosol passes, and a mouthpiece 26 including an outlet 26*e* for discharging the aerosol passing through the second material 22 to the outside.

The first cartridge 10 may accommodate the first material 12 and include a delivery hole 11 through which the aerosol generated from the first material 12 is delivered to the second cartridge 20.

As in the embodiment shown in FIGS. 1 through 3, an atomizer may be installed at the first cartridge 10, or an atomizer may be installed inside a case on which the first cartridge 10 is mounted.

The second cartridge 20 may include a plurality of chambers 21 that are arranged to rotate with respect to the first cartridge 10 and are sequentially positioned along a rotation direction, a lower through hole 20*f* which is positioned under the chambers 21 and through which the aerosol passes, and a second material 22, which is accommodated in each of the chambers 21 and through which the aerosol passes. The chambers 21 may be partitioned independently from each other by partition walls 22*w*.

Unlike in the embodiments shown in FIGS. 1 through 3 and 15, the aerosol generating assembly 5 of the aerosol generating device according to the embodiment shown in FIG. 17 may not include a rotation shaft for supporting the second cartridge 20. The second cartridge 20 and the first cartridge 10 may have a cylindrical shape, and a rotation guide 130 for guiding the rotation motion of the second cartridge 20 with respect to the first cartridge 10 may be installed between the second cartridge 20 and the first cartridge 10.

The rotation guide 130 may include a rail 131 that protrudes from an outer surface of the first cartridge 10 and extends along the circumferential direction of the first cartridge 10, and a circumference groove 132 that extends along the circumferential direction of the second cartridge 20 on an inner surface of the second cartridge 20, accommodates the rail 131 and supports the rail 131 while the second cartridge 20 performs a rotational motion.

Embodiments of the present disclosure are not limited by the configuration of the rotation guide 130 shown in FIG. 17, and for example, the circumference groove 132 may be installed in the first cartridge 10, and the rail 131 may be installed on the second cartridge 20, and may include a bearing additionally installed between the second cartridge 20 and the first cartridge 10.

A position sensor 160 that detects the position of at least one of the chambers 21 with respect to the delivery hole 11 to generate a position signal may be installed between the first cartridge 10 and the second cartridge 20.

The position sensor 160 may include a plurality of magnetic bodies 161 that are apart from each other along the rotation direction of the second cartridge 20 and have magnetism with different strengths, and a hall sensor 162 that is arranged in the first cartridge 10 and detects the intensity of magnetism of the plurality of magnetic bodies 161. Embodiments of the present disclosure are not limited by the arrangement positions or the number of magnetic bodies 161 and hall sensors 162, and for example, the magnetic bodies 161 may be arranged in the first cartridge 10, and the hall sensor 162 may be arranged in the second cartridge 20.

Figure 18:
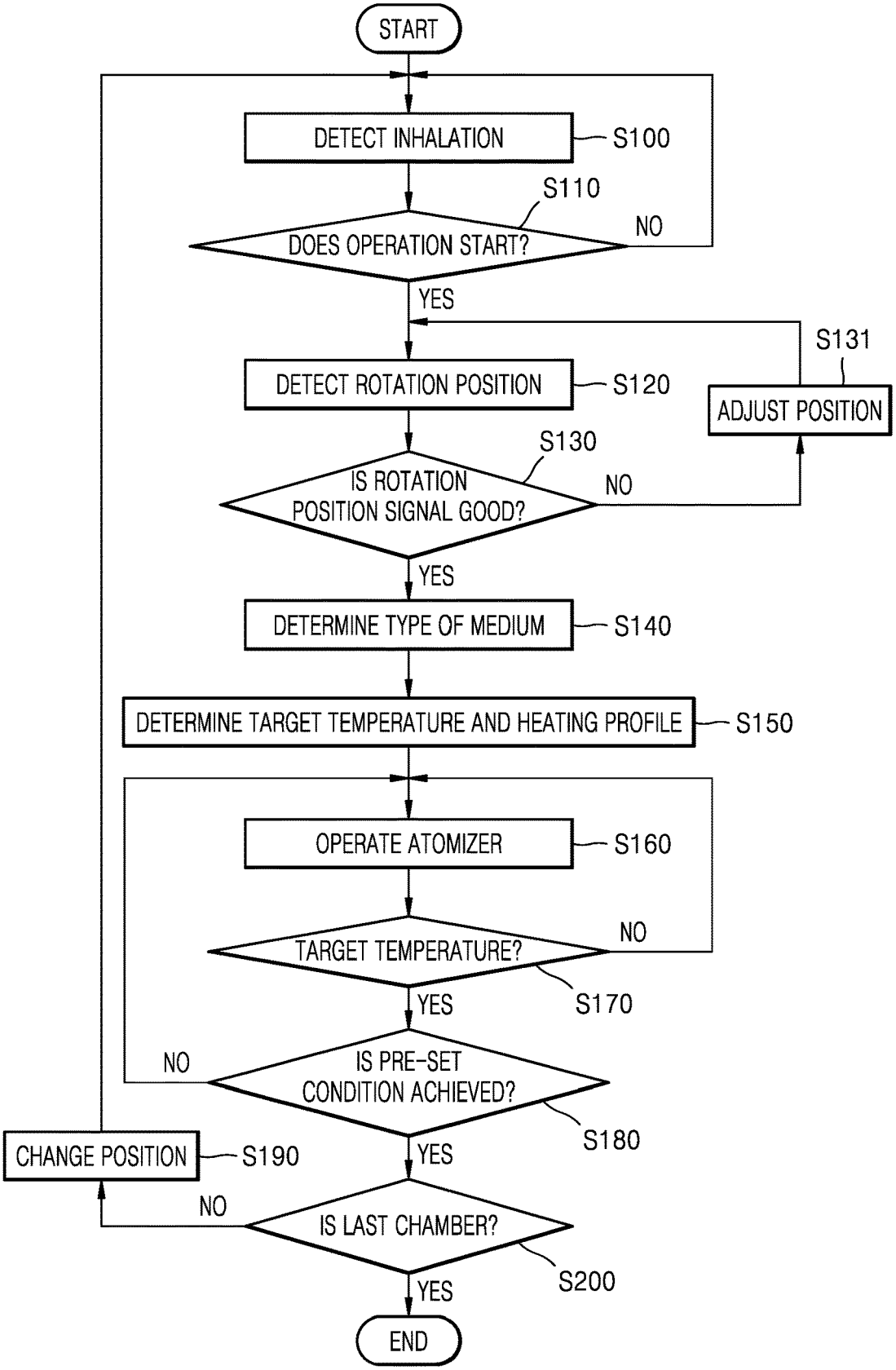
FIG. 18 is a flowchart schematically illustrating a method of generating an aerosol by using the aerosol generating device according to the embodiments shown in FIGS. 1 through 17.

FIG. 18 is a flowchart schematically illustrating a method of generating an aerosol by using the aerosol generating device according to the embodiments shown in FIGS. 1 through 17.

The method of generating an aerosol according to the embodiment shown in FIG. 18 may include detecting a user's inhalation operation (S100), determining that the inhalation operation has been detected to start an aerosol-supplying operation (S110), detecting a rotation position of the second cartridge with respect to the first cartridge (S120), determining whether a signal of the detected rotation position of the second cartridge is good (S130), when the signal of the rotation position is not good, adjusting the rotation position of the second cartridge (S131), when the signal of the rotation position of the second cartridge is good, determining the type of a medium currently in use to supply the aerosol (e.g. the type of a second material based on the signal of the rotation position of the second cartridge) (S140), determining at least one of a target temperature for an operation of an atomizer and a heating profile for controlling a heating operation of the atomizer based on the determined type of the medium (S150), operating the atomizer based on the target temperature or the heating profile (S160), detecting a current temperature and comparing the current temperature with the target temperature (S170), determining whether a pre-set condition is achieved (S180), when the pre-set condition is achieved, checking whether a current usage chamber is the last chamber among chambers of the second cartridge (S200), and when the current usage chamber is not the last chamber, changing relative positions of the first cartridge and the second cartridge (S190).

According to embodiments, the term 'last chamber' may refer to a last chamber in a positional order and/or a usage order of the chambers.

A pre-set condition for changing the relative positions of the first cartridge and the second cartridge may include a cumulative time of heating operations of generating heat by using a heater so as to generate the aerosol or a combination of the cumulative time of the heating operations of the heater and the heating temperature of the heater.

Alternatively, the pre-set condition for changing the relative positions of the first cartridge and the second cartridge may include any one of the number of puff operations determined based on a signal detected by a puff sensor and the cumulative time of the puff operations or a combination thereof.

Alternatively, the pre-set condition for changing the relative positions of the first cartridge and the second cartridge may include a usage time determined based on an input signal generated when an input device receives the user's input.

By performing changing the relative positions of the first cartridge and the second cartridge (S190), a usage chamber, among the chambers of the second cartridge, through which the aerosol currently passes may be replaced so that the position of a subsequent chamber may be changed into a position corresponding to a delivery hole of the first cartridge. The changing of the relative positions of the first cartridge and the second cartridge (S190) may be automatically performed by a driving device operated by a controller or by the user's manual manipulation.

The changing of the relative positions of the first cartridge and the second cartridge (S190) may include, when the pre-set condition is achieved, providing a notification for indicating the need to change positions of the chambers to the user, receiving an input signal generated when the user manipulates the input device, providing information on a chamber, among the chambers of the second cartridge, which is aligned with a delivery hole of the first cartridge to the user, and changing the position of at least one of the first cartridge and the second cartridge by operating the driving device based on input manipulation received from the input device.

When the relative positions of the first cartridge and the second cartridge are changed, the usage chamber may immediately depart from the position corresponding to the delivery hole, the subsequent chamber may be aligned with the delivery hole and then, the aerosol may pass through the subsequent chamber as a new usage chamber, or the usage chamber and the subsequent chamber may perform an operation of passing the aerosol temporarily together, and as time passes, only the subsequent chamber may perform the operation of passing the aerosol as the new usage chamber.

After the changing of the relative positions of the first cartridge and the second cartridge (S190), the process may return to detecting of the user's inhalation operation (S100), thereby repeatedly performing the above-described operations.

Even when the first cartridge of the aerosol generating device is designed to accommodate a large amount of the first material, the second cartridge may be automatically rotated by the driving device to select chambers used for supplying an aerosol, so that the effect of replacing the second cartridge including the second material with a new second material may be obtained without replacing the second cartridge including the second material.

In addition, because the chambers of the second cartridge may include different types of second material, the user may select one from among the chambers to select a desired second material so that the user may freely enjoy an aerosol having various flavors.

Those of ordinary skill in the art related to the present embodiments may understand that various changes in form and details can be made therein without departing from the scope of the characteristics of the present disclosure. The disclosed methods should be considered in a descriptive sense only and not for purposes of limitation.

INDUSTRIAL APPLICABILITY

One or more embodiments of the present disclosure relate to an aerosol generating device in which positions of chambers according to changes in the relative positions of a first cartridge and a second cartridge may be identified so that it may be convenient to carry and use the aerosol generating device.

The invention claimed is:

1. An aerosol generating device comprising:

a first cartridge configured to accommodate a first material and comprising a delivery hole that is configured to deliver an aerosol generated from the first material;

a second cartridge comprising a plurality of chambers that are each configured to accommodate a second material through which the aerosol delivered from the first cartridge passes and is discharged to the outside, wherein a position of the second cartridge with respect to the first cartridge is changeable so that at least one of the plurality of chambers corresponds to the delivery hole;

a position sensor configured to generate a signal by detecting a position of at least one of the plurality of chambers with respect to the delivery hole;

a controller configured to identify a usage chamber, among the plurality of chambers and which is aligned to correspond to a position of the delivery hole to pass the aerosol, based on the signal of the position sensor, and a driving device configured to change a relative position of the second cartridge with respect to the first cartridge by moving at least one from among the first cartridge and the second cartridge, wherein the controller is configured to operate the driving device to change the relative position of the second cartridge with respect to the first cartridge so that the aerosol is able to pass through at least one of the plurality of chambers, and wherein the aerosol generating device further comprising a reference sensor arranged on a movement path between the first cartridge and the second cartridge and configured to generate a reference position signal indicating a reference position of the second cartridge with respect to the first cartridge, and based on the reference sensor generating the reference position signal, the controller is configured to convert a movement direction of any one from among the first cartridge and the second cartridge into an opposite direction, or wherein the aerosol generating device further comprising a stopper arranged on a movement path between the first cartridge and the second cartridge and configured to be in contact with any one from among the first cartridge and the second cartridge to limit position movement, and when any one from among the first cartridge and the second cartridge is moved in one direction by the driving device and comes into contact with the stopper, the controller is configured to control the driving device to attempt to further move the any one from among the first cartridge and the second cartridge in the one direction and then convert a movement direction of the any one from among the first cartridge and the second cartridge into an opposite direction.

2. The aerosol generating device of claim 1, wherein the controller is configured to identify that two adjacent chambers of the plurality of chambers, which are both aligned to correspond to the position of the delivery hole to pass the aerosol, are simultaneous usage chambers based on the signal of the position sensor.

3. The aerosol generating device of claim 2, wherein the controller is configured to operate the driving device to change the relative position of the second cartridge with respect to the first cartridge by moving at least one from among the first cartridge and the second cartridge, so that the aerosol is able to simultaneously pass through the two adjacent chambers of the plurality of chambers.

4. The aerosol generating device of claim 1, wherein the position sensor comprises:

a plurality of electric resistors that are arranged at different positions between the first cartridge and the second cartridge and have different electric resistance values from each other so as to correspond to changes in relative positions of the first cartridge and the second cartridge, and a conducting wire configured to be electrically connected to the plurality of electric resistors, wherein the controller is configured to identify the position of the at least one of the plurality of chambers based on electricity flowing through at least one of the plurality of electric resistors.

5. The aerosol generating device of claim 1, wherein the position sensor comprises:

a plurality of magnetic bodies that are arranged at different positions between the first cartridge and the second cartridge and have magnetism with different strengths from each other so as to correspond to changes in relative positions of the first cartridge and the second cartridge, and a magnetism sensor configured to detect the magnetism of the plurality of magnetic bodies.

6. The aerosol generating device of claim 1, wherein the position sensor comprises at least one switch that is positioned on a movement path between the first cartridge and the second cartridge, the at least one switch configured to operate according to changes in relative positions of the first cartridge and the second cartridge to generate a position signal indicating positions of the plurality of chambers.

7. The aerosol generating device of claim 1, wherein the position sensor comprises one or more transmitters and one or more receivers, the one or more receivers being configured to detect the one or more transmitters, wherein the signal generated by the position sensor is based on a state in which the one or more receivers detect the one or more transmitters, and wherein the one or more transmitters are on the first cartridge and the one or more receivers are on the second cartridge, or the one or more transmitters are on the second cartridge and the one or more receivers are on the first cartridge.

8. The aerosol generating device of claim 1, wherein, when the position of the at least one of the plurality of chambers is aligned to correspond to the delivery hole, the position sensor generates a unique identification signal corresponding to the at least one of the plurality of chambers that is aligned.

9. The aerosol generating device of claim 1, wherein any one from among the first cartridge and the second cartridge is rotatably coupled to the other one from among the first cartridge and the second cartridge, and the position sensor is configured to detect changes in a rotation position of the any one from among the first cartridge and the second cartridge.

10. The aerosol generating device of claim 1, wherein any one from among the first cartridge and the second cartridge is linearly and movably coupled to the other one from among the first cartridge and the second cartridge, and the position sensor is configured to detect changes in a linear position of the any one from among the first cartridge and the second cartridge.

11. The aerosol generating device of claim 1, further comprising a handle that is configured to be manipulated by a user so as to change relative positions of the first cartridge and the second cartridge, and is further configured to transmit force of the user to move at least one from among the first cartridge and the second cartridge.

12. The aerosol generating device of claim 1, further comprising:

a handle that is configured to be manipulated by a user so as to change relative positions of the first cartridge and the second cartridge, and a force transmission unit configured to transmit force of the user, transmitted to the handle, to any one from among the first cartridge and the second cartridge, wherein the position sensor comprises at least one switch that is connected to at least one from among the handle and the force transmission unit, and the signal of the position sensor indicates positions of the plurality of chambers according to changes in the relative positions of the first cartridge and the second cartridge.

13. The aerosol generating device of claim 1, further comprising an information generator that is configured to be controlled by the controller to output information on the usage chamber, among the plurality of chambers, which is aligned to correspond to the position of the delivery hole to pass the aerosol.

* * * * *